US010642217B2

(12) United States Patent
Makino et al.

(10) Patent No.: US 10,642,217 B2
(45) Date of Patent: May 5, 2020

(54) DEVELOPER SUPPLY SYSTEM, DEVELOPER SUPPLY CONTAINER MOUNTING METHOD AND DEVELOPER SUPPLY UNIT

(71) Applicant: CANON KABUSHIKI KAISHA, Tokyo (JP)

(72) Inventors: Yusaku Makino, Nagareyama (JP); Nobuyuki Yomoda, Kashiwa (JP); Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/354,718

(22) Filed: Mar. 15, 2019

(65) Prior Publication Data

US 2019/0212695 A1 Jul. 11, 2019

Related U.S. Application Data

(63) Continuation of application No. PCT/JP2018/036618, filed on Sep. 21, 2018.

(30) Foreign Application Priority Data

Sep. 21, 2017 (JP) ..... 2017-181800

(51) Int. Cl.
*G03G 21/16* (2006.01)
*G03G 15/08* (2006.01)

(52) U.S. Cl.
CPC ..... *G03G 21/1647* (2013.01); *G03G 15/08* (2013.01); *G03G 21/16* (2013.01); *G03G 21/1676* (2013.01)

(58) Field of Classification Search
CPC ..... G03G 21/1647; G03G 21/1676
See application file for complete search history.

(56) References Cited

U.S. PATENT DOCUMENTS 9,811,024 B2 11/2017 Yomoda et al.
10,133,211 B2 11/2018 Yomoda
(Continued)

FOREIGN PATENT DOCUMENTS

JP 2007-041104 A 2/2007
JP 2009-036952 A 2/2009
(Continued)

OTHER PUBLICATIONS

Co-pending U.S. Appl. No. 16/354,333, filed Mar. 15, 2019.
(Continued)

*Primary Examiner* — Gregory H Curran
(74) *Attorney, Agent, or Firm* — Venable LLP

(57) ABSTRACT

A developer supply container is detachably mountable to a developer receiving apparatus including a developer receiving portion provided with a receiving opening for receiving a developer, and a portion-to-be-engaged 11*b* integrally displaceable with the developer receiving portion. The developer supply container includes a discharging portion provided with a shutter opening for discharging the developer accommodated in the developer accommodating portion. An operation portion 21 displaces the developer receiving portion to bring the receiving opening into communication with the shutter opening by engagement between the engaging portion 21*d* and the portion-to-be-engaged 11*b* by a predetermined operation executed after the developer supply container is mounted to a predetermined position of the developer receiving apparatus.

4 Claims, 32 Drawing Sheets

(56) References Cited

U.S. PATENT DOCUMENTS

| | | | | |
|---|---|---|---|---|
| 10,261,441 | B2 | 4/2019 | Jimba et al. | |
| 2007/0280743 | A1* | 12/2007 | Nakajima | G03G 15/0886 399/262 |
| 2012/0014722 | A1* | 1/2012 | Okino | G03G 15/0867 399/262 |
| 2012/0155924 | A1 | 6/2012 | Iino | |
| 2014/0153974 | A1 | 6/2014 | Jimba et al. | |
| 2016/0004187 | A1* | 1/2016 | Yomoda | G03G 15/08 399/260 |
| 2018/0024465 | A1 | 1/2018 | Yomoda et al. | |
| 2019/0204778 | A1 | 7/2019 | Gamo et al. | |
| 2019/0212672 | A1 | 7/2019 | Gamo et al. | |
| 2019/0212693 | A1 | 7/2019 | Okino et al. | |

FOREIGN PATENT DOCUMENTS

| | | | |
|---|---|---|---|
| JP | 2013-015826 | A | 1/2013 |
| JP | 2013-152361 | A | 8/2013 |

OTHER PUBLICATIONS

Co-pending U.S. Appl. No. 16/354,227, filed Mar. 15, 2019.
Co-pending U.S. Appl. No. 16/353,215, filed Mar. 14, 2019.
International Search Report and Written Opinion for International Patent Application No. PCT/JP2018/036618, dated Dec. 11, 2018.

* cited by examiner (a)

(b)

(c)

(a)

(b)

(a)

(b)

(a)

(b)

(a)

(b)

(a)

(b)

(a)

(b)

(a)

(b)

(a)

(b)

(a)

(b)

DEVELOPER SUPPLY SYSTEM, DEVELOPER SUPPLY CONTAINER MOUNTING METHOD AND DEVELOPER SUPPLY UNIT

TECHNICAL FIELD

The present invention relates to a developer supply container dismountably mountable to a developer receiving apparatus and a developer supplying system.

BACKGROUND ART

Conventionally, in electrophotographic image forming apparatuses such as copying machines, fine developing powder such as toner has been used. In such an image forming apparatus, the developer consumed by the image formation is supplemented from a developer supply container.

For example, a structure has been proposed in which the developer supply container is mountable to and dismountable from a developer receiving apparatus provided in the image forming apparatus, and the developer receiving portion of the developer receiving apparatus is displaced toward the discharge opening of the developer supply container in accordance with the mounting operation of the developer supply container (JP2013-015826A).

SUMMARY OF THE INVENTION

Problems to be Solved by Invention

It is an object of the present invention to provide a structure further improving the structure described in the above-mentioned Japanese Patent Application Laid-open No. 2013-015826.

Means for Solving the Problem

According to one aspect of the present invention, there is provided a developer supplying system comprising a developer receiving apparatus including a developer receiving portion provided with a receiving opening for receiving a developer; and a developer supply container detachably mountable to said developer receiving apparatus, said developer supply container including a developer accommodating portion for accommodating the developer, and a discharging portion provided with a discharge opening for discharging the developer accommodated in said developer accommodating portion, wherein said developer receiving portion is provided with a force receiving portion for receiving a force for moving said developer receiving portion toward said developer supply container to bring said receiving opening into communication with, said discharge opening by a manual operation after said developer supply container is mounted to said developer receiving apparatus.

Effect of the Invention

According to the present invention, a further improved structure can be provided.

Figure 3:
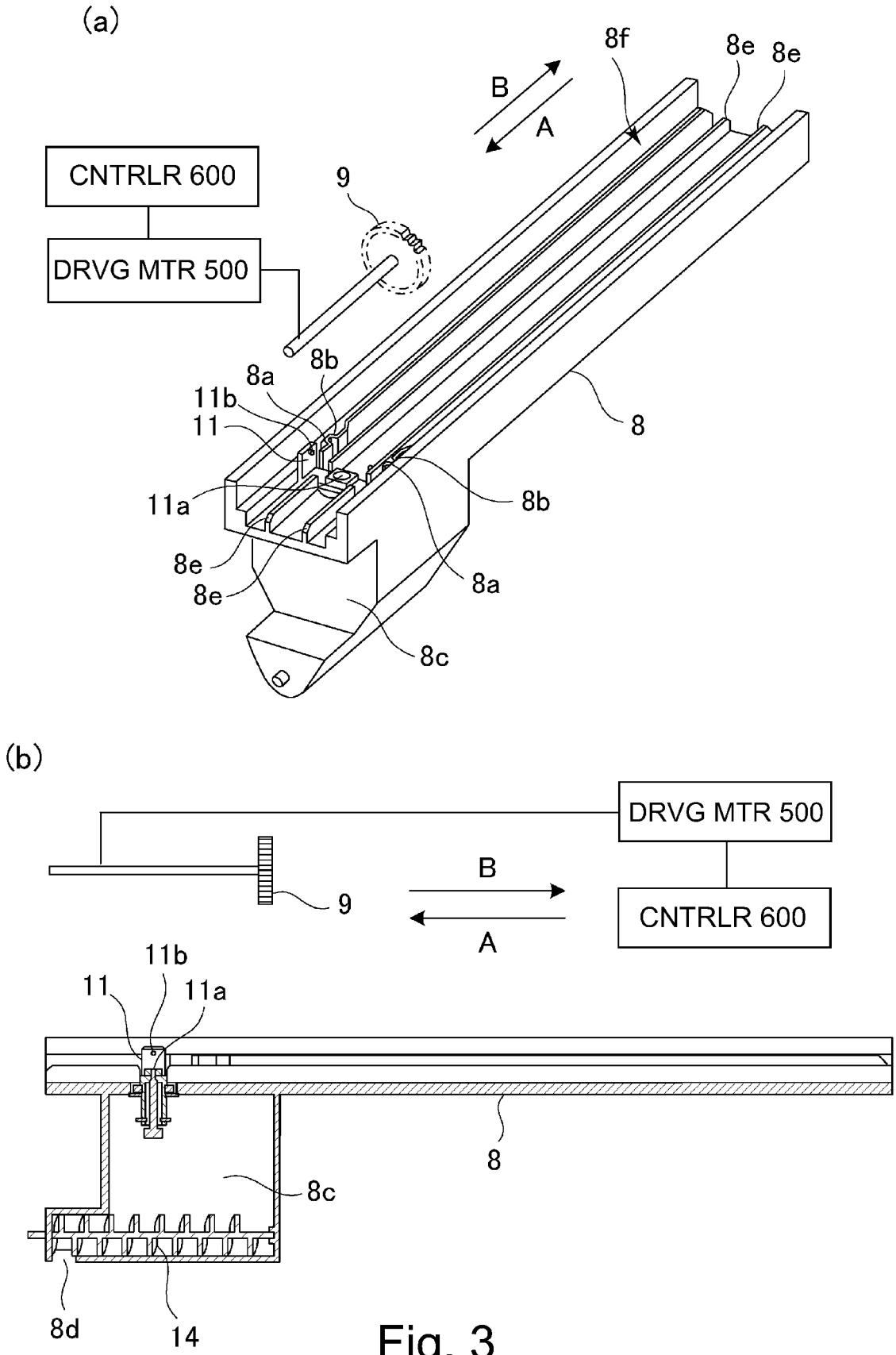

Parts (a) and (b) of FIG. 3 show a developer receiving apparatus according to Embodiment 1, in which part (a) is a perspective view thereof, and part (b) is a cross-sectional view thereof.

Figure 4:
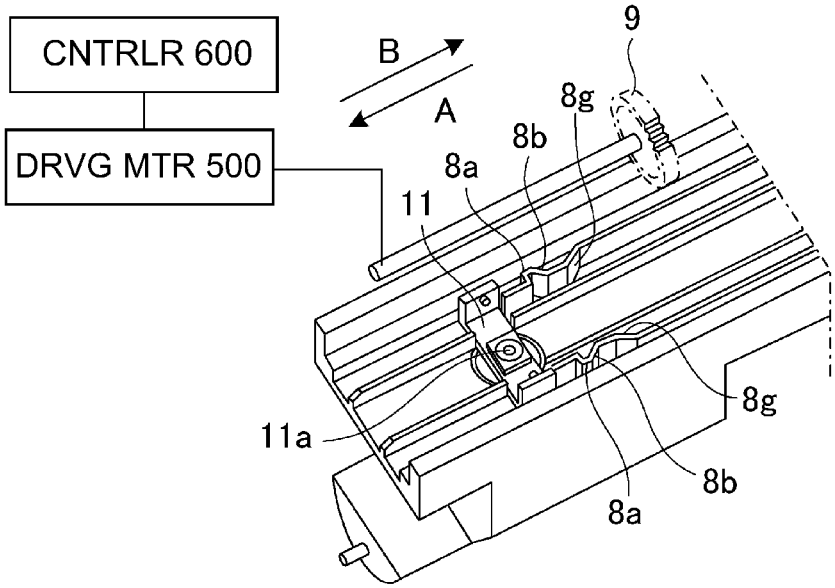
Figure 4:
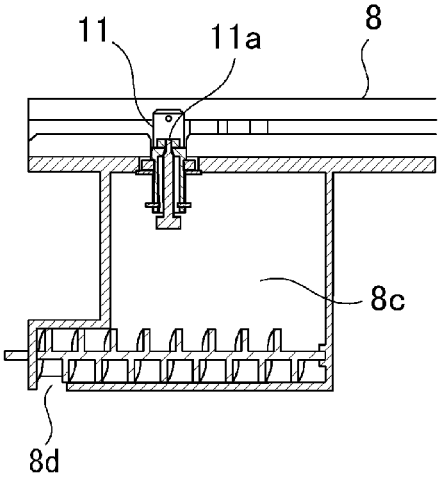
Figure 4:
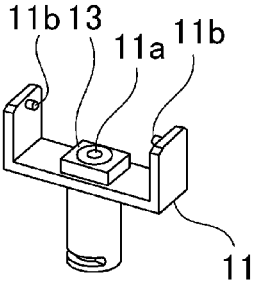

Parts (a), (b) and (c) of FIG. 4 show a developer receiving apparatus according to Embodiment 1, in which part (a) is an enlarged partial perspective view thereof, part (b) is an enlarged cross sectional view thereof, and part (c) is a perspective view of a developer receiving portion.

Figure 5:
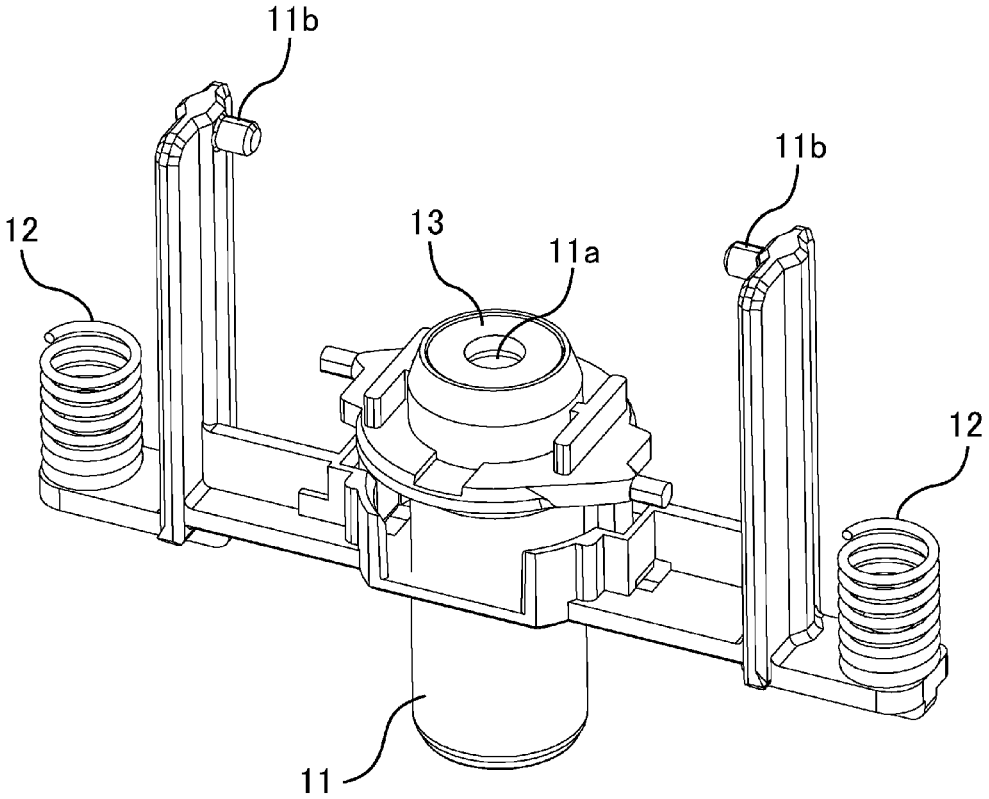

FIG. 5 is a detailed perspective view of the developer receiving portion according to Embodiment 1.

Figure 6:
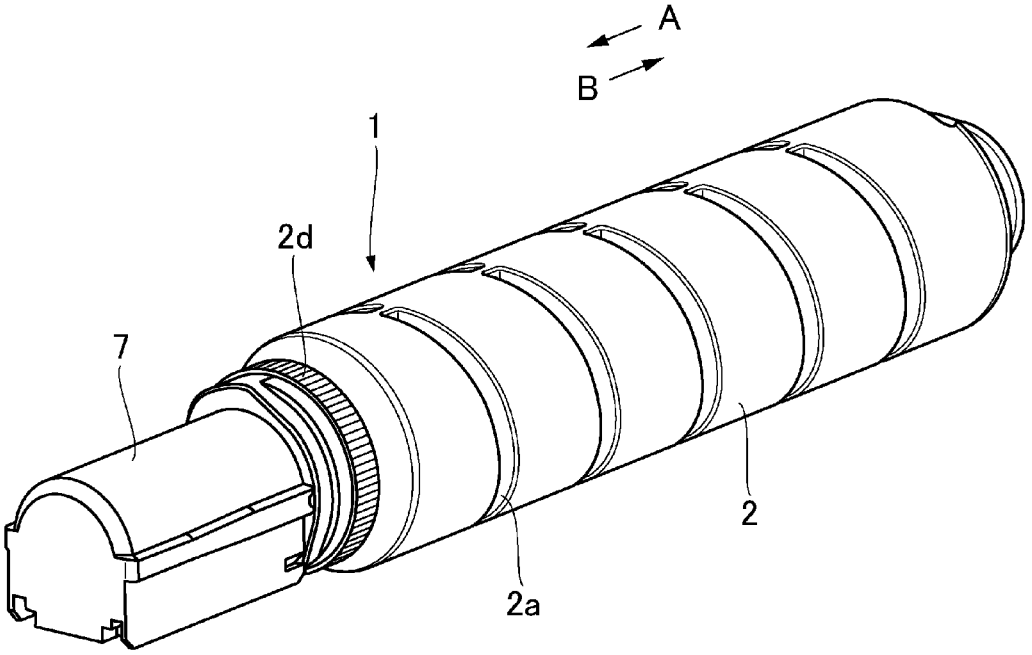

FIG. 6 is a perspective view of basic components of the developer supply container according to Embodiment 1.

Figure 7:
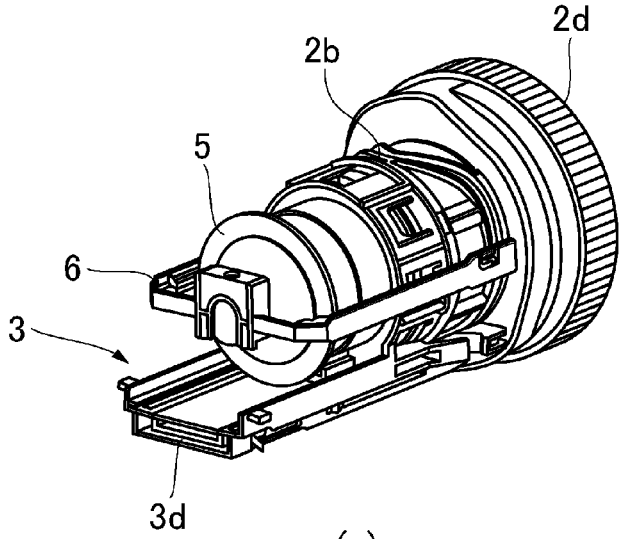
Figure 7:
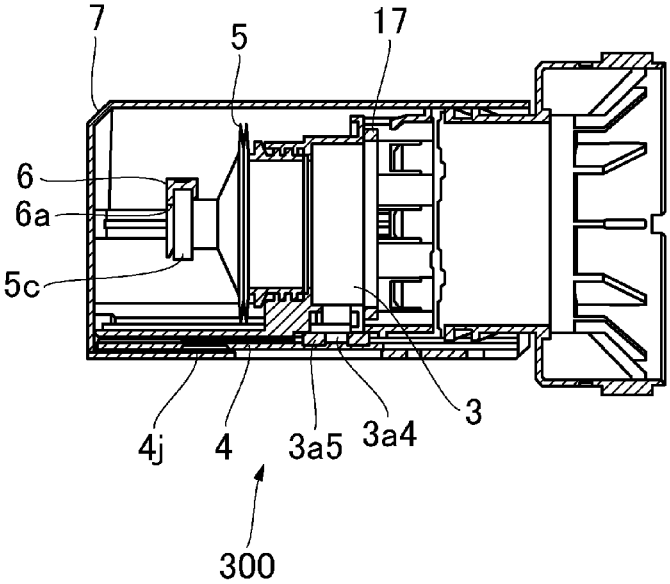

Parts (a) and (b) of FIG. 7 show end portions of the developer supply container according to Embodiment 1, (a) is a perspective view illustrating the state with the cover removed, (b) is a cross-sectional view of the end portion of the developer supply container.

Figure 8:
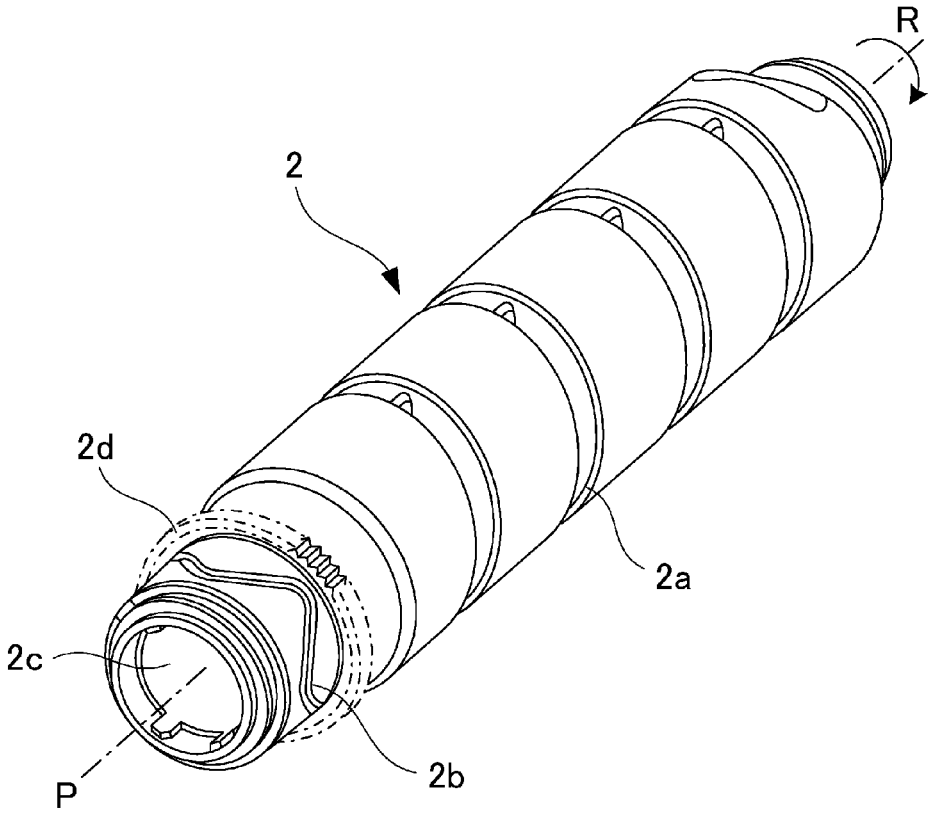

FIG. 8 is a perspective view of the container body of the developer supply container according to Embodiment 1.

Figure 9:
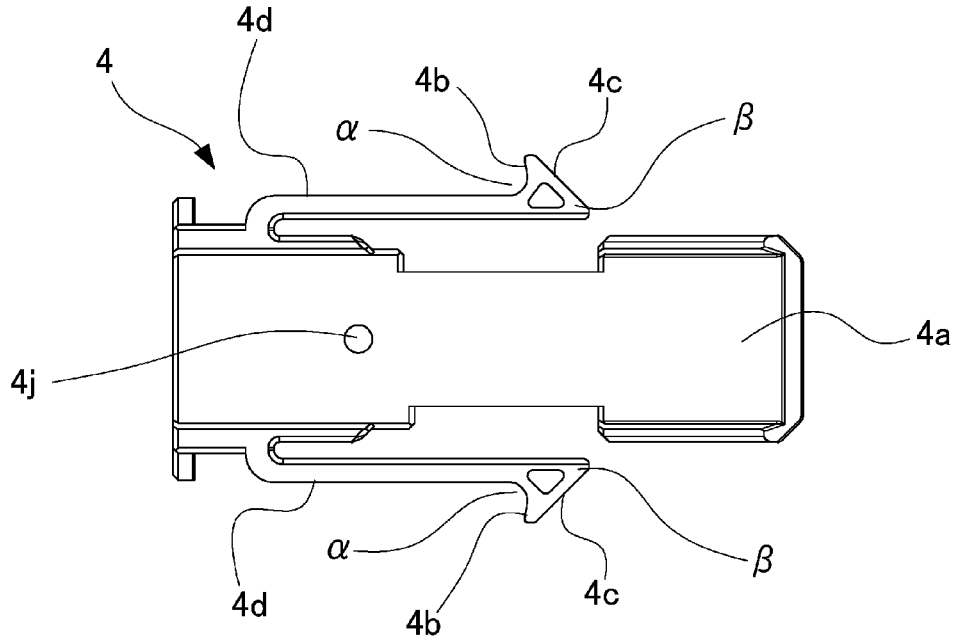
Figure 9:
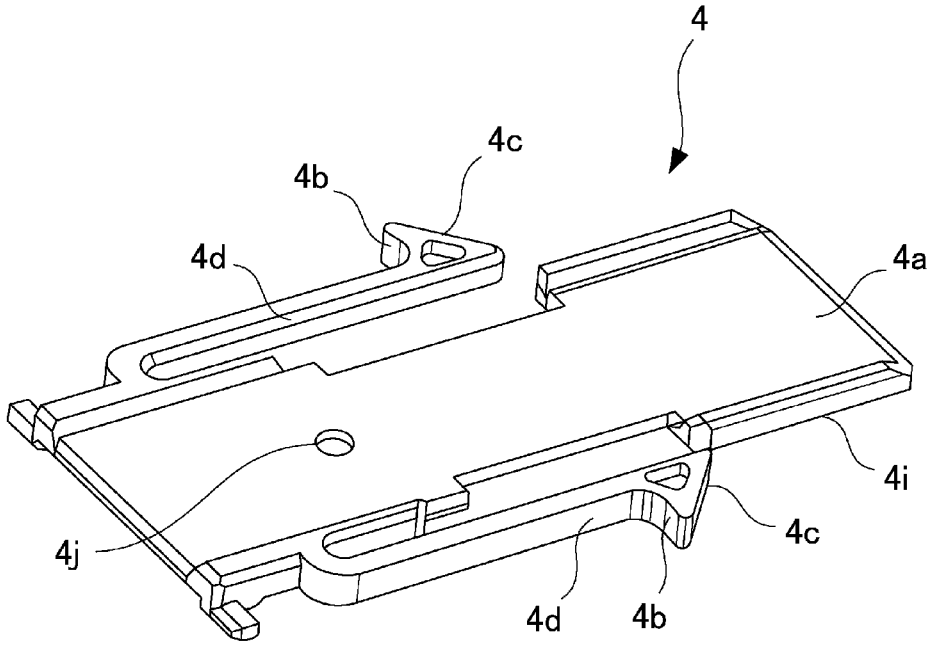

Parts (a) and (b) of FIG. 9 show a shutter according to Embodiment 1, in which (a) is a top plan view, and (b) is a perspective view.

Figure 10:
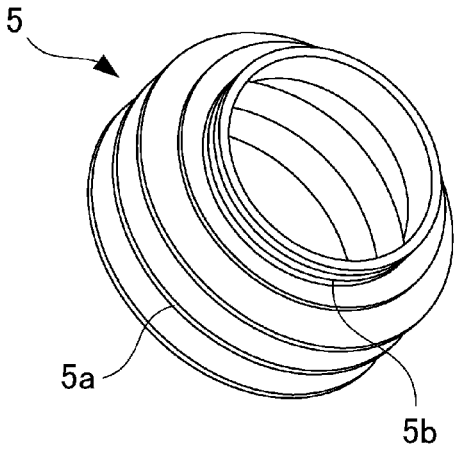
Figure 10:
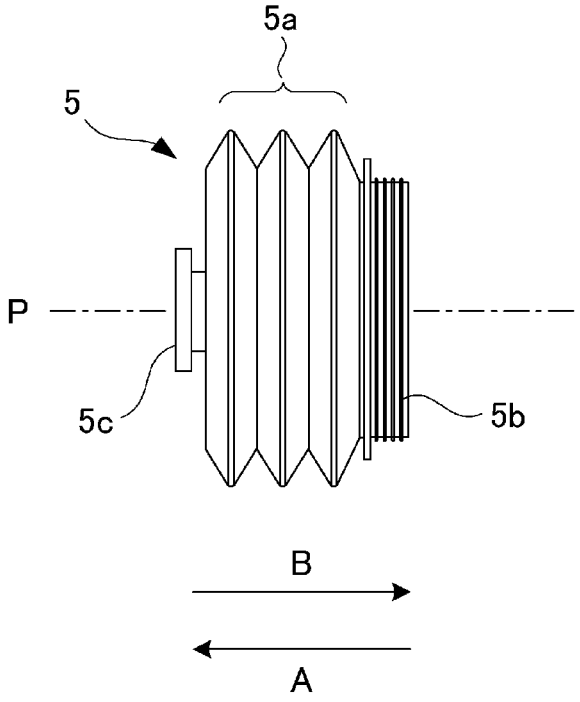

Parts (a) and (b) of FIG. 10 show the shutter according to Embodiment 1, in which part (a) is a top view, and part (b) is a perspective view.

Figure 11:
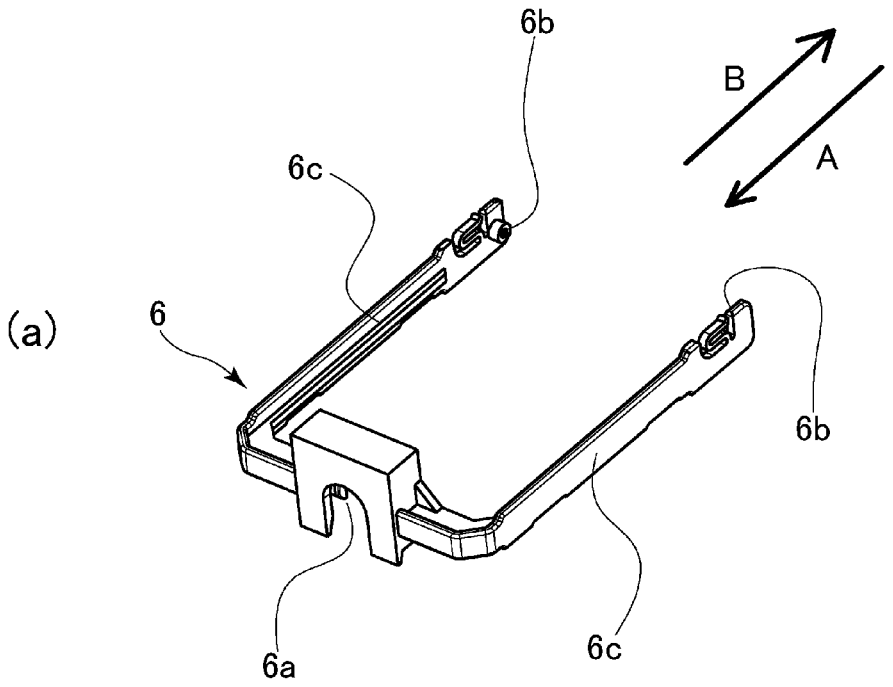
Figure 11:
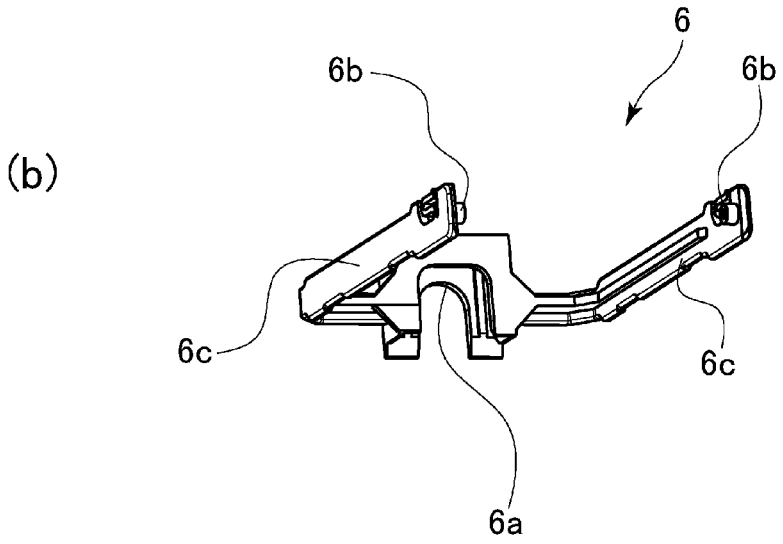

Parts (a) and (b) of FIG. 11 show the pump according to Embodiment 1, in which part (a) is a perspective view, and part (b) is a side view.

Figure 12:
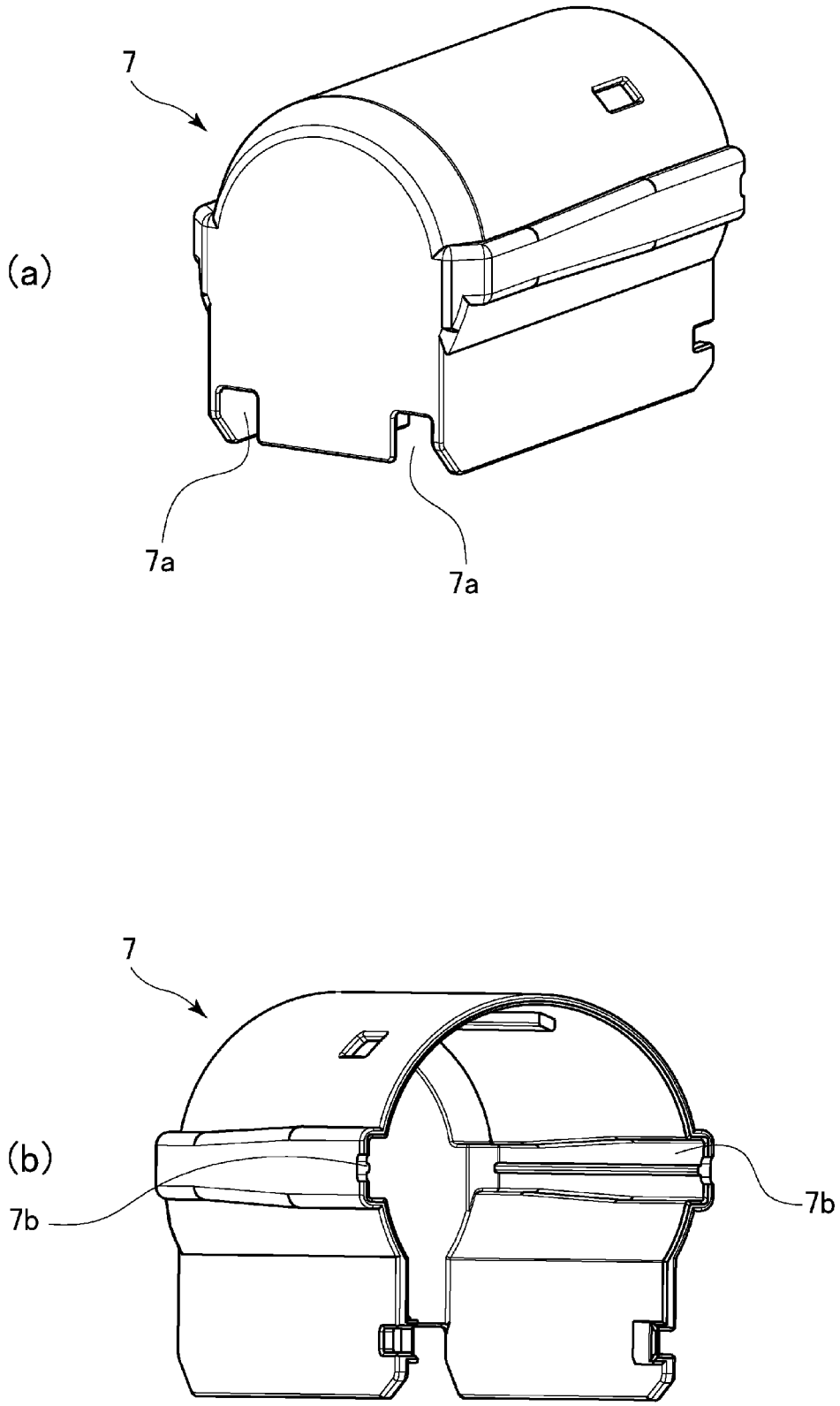

Parts (a) and (b) of FIG. 12 show the reciprocating member according to Embodiment 1, in which part (a) is a perspective view, part (b) is a perspective view as viewed from the opposite side of part (a).

Figure 13:
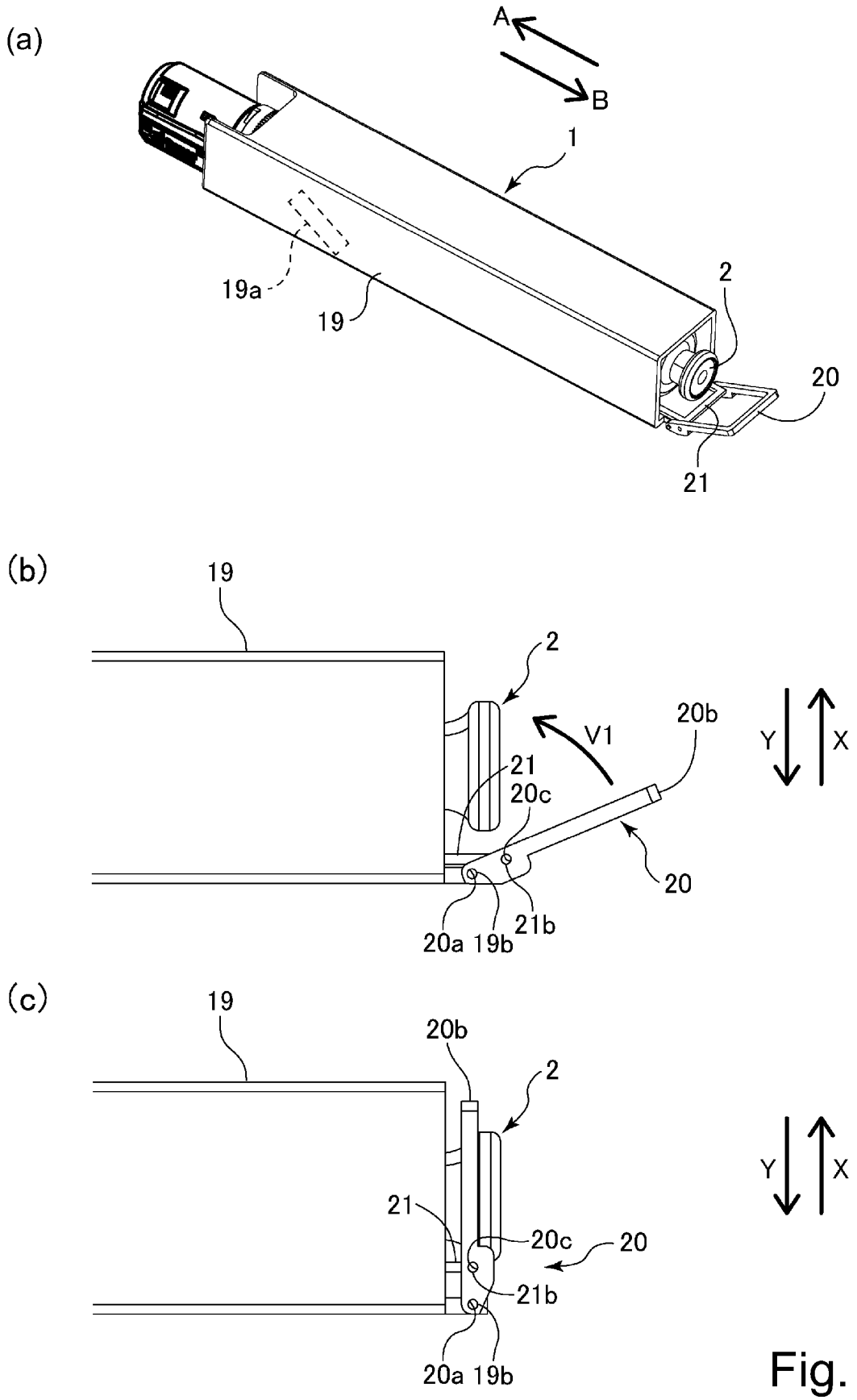

Parts (a), (b) and (c) of FIG. 13 show the developer supply container according to Embodiment 1, in which (a) is a perspective view, (b) is a side view showing the state in which a manipulating portion is in a first position, and (c) is a side view show in the state in which the manipulating portion is in a second position.

Figure 14:
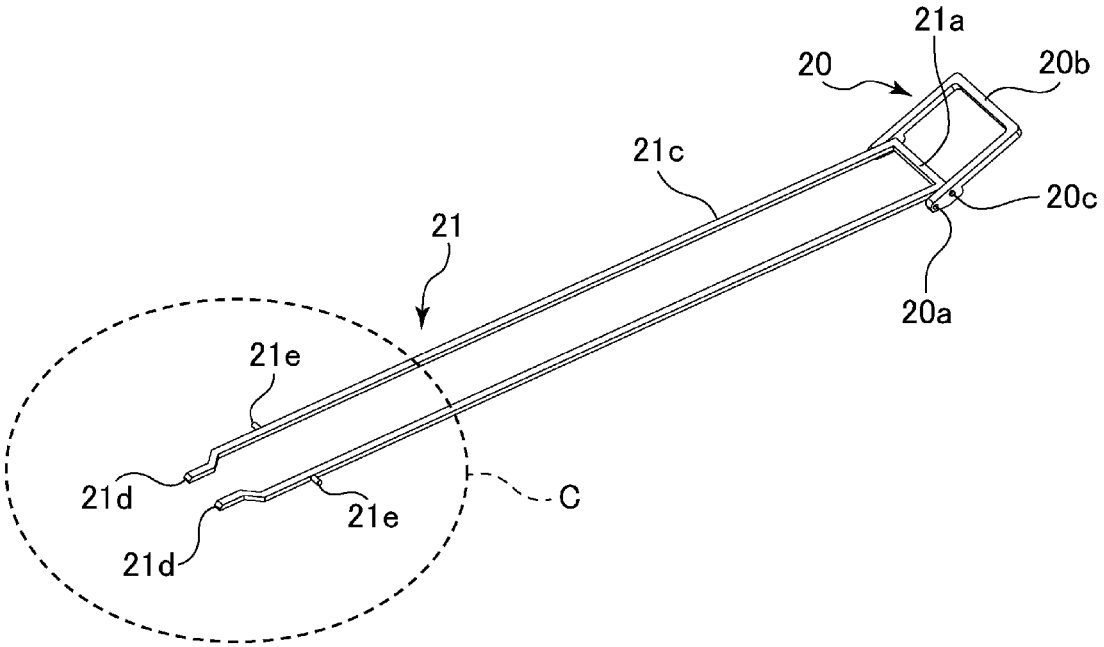
Figure 14:
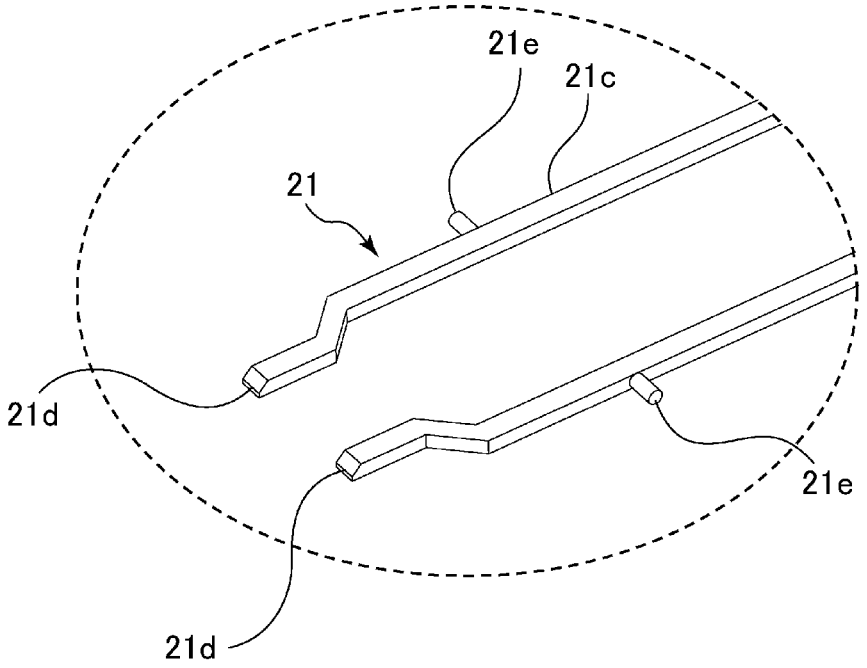

Part (a) of FIG. 14 is a perspective view of the manipulating portion and an operating portion according to Embodiment 1, and part (b) of FIG. 14 is an enlarged view of section C of part (a) of this Figure.

Figure 15:
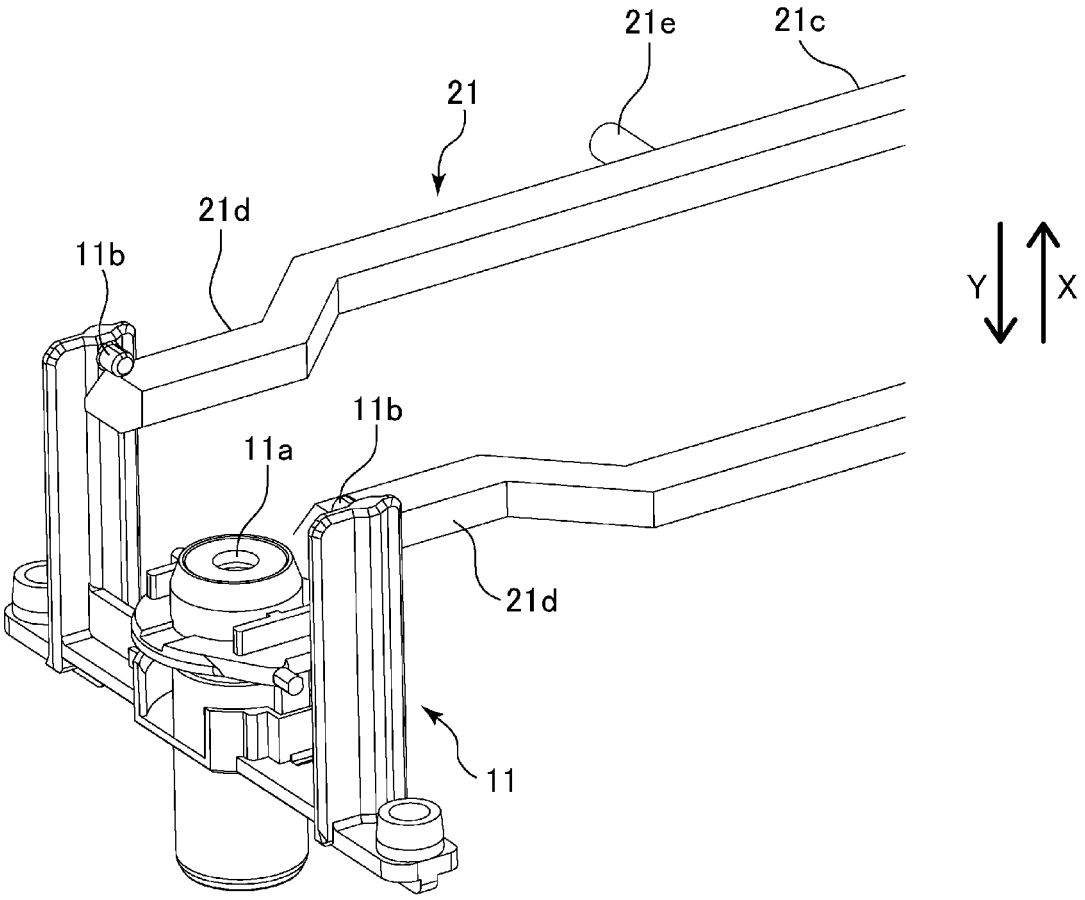

FIG. 15 is a perspective view illustrating a state of engagement between an engaging portion and an engaged portion (a portion-to-be-engaged) of the developer receiving portion according to Embodiment 1.

Figure 16:
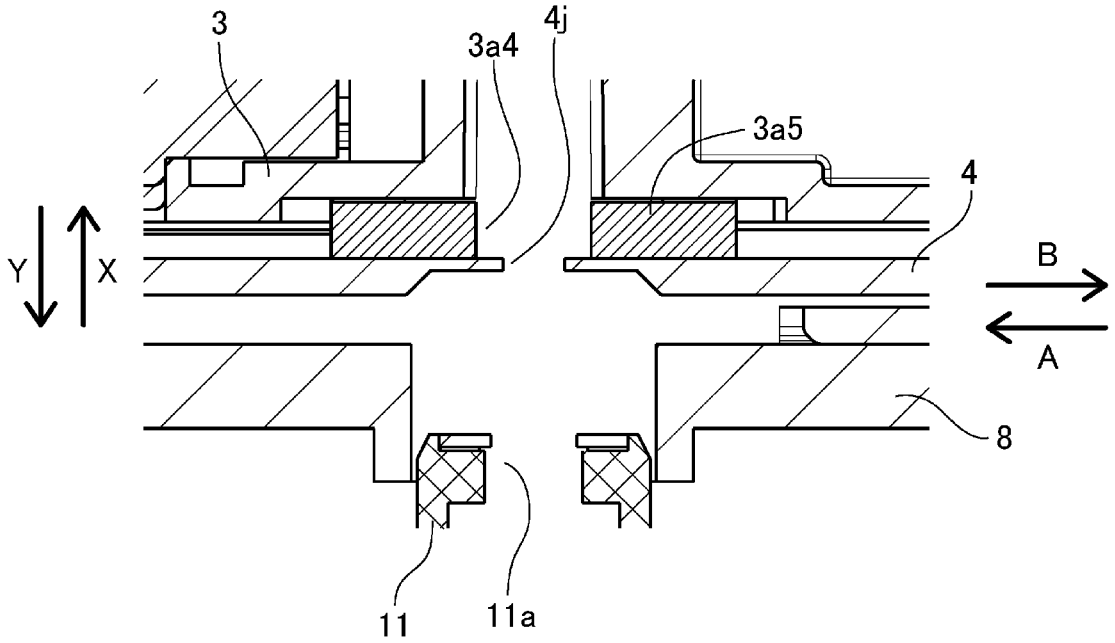
Figure 16:
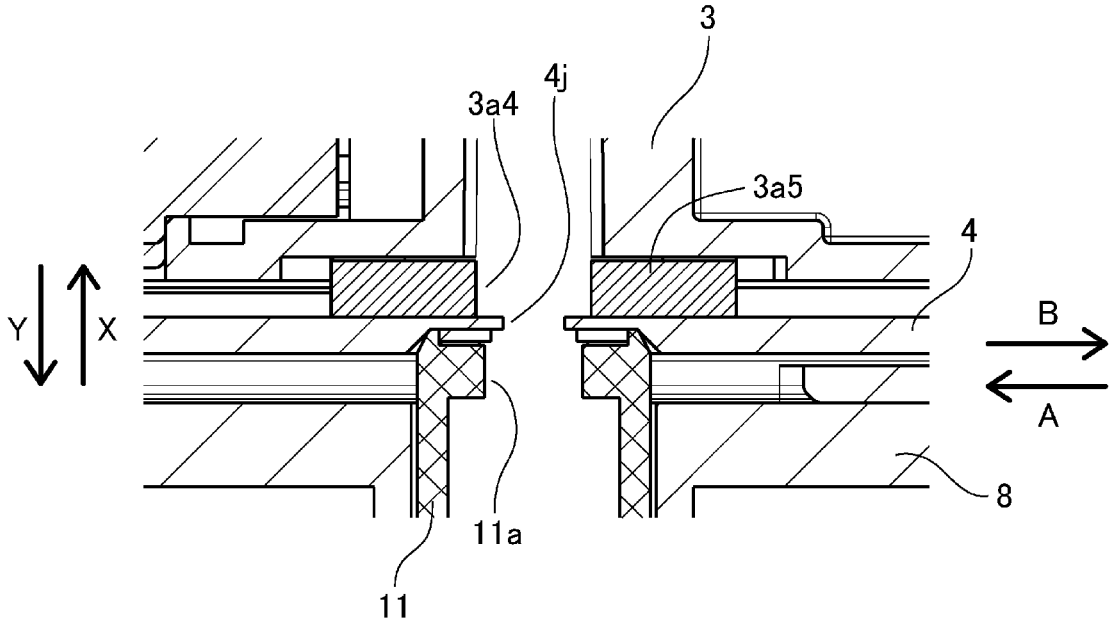

Part (a) and part (b) of FIG. 16 show the developer receiving portion according to Embodiment 1, in which part (a) is a partial cross-sectional view in the neighborhood of the developer receiving portion after mounting of the developer supply container, and part (b) is a partial sectional view in the neighborhood of the developer receiving portion after a predetermined operation with the developer supply container mounted.

Figure 17:
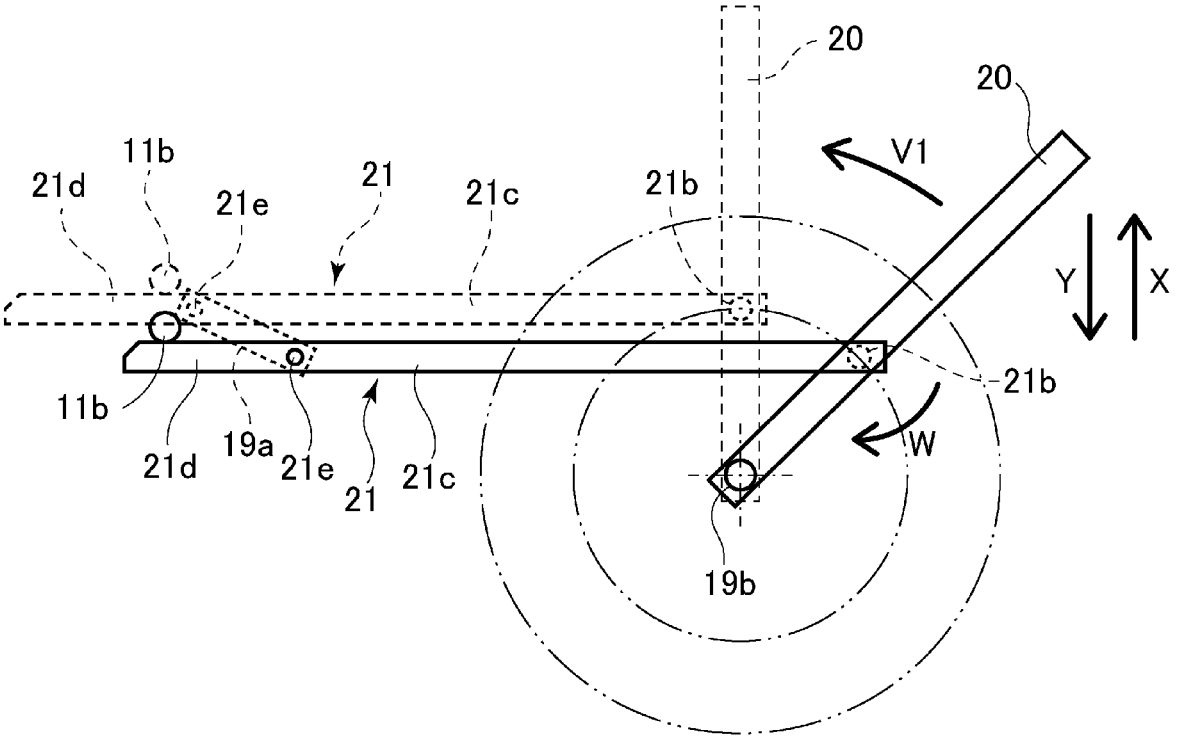

FIG. 17 is a schematic illustration showing the operation of the operation portion by operating the manipulating portion according to Embodiment 1.

Figure 18:
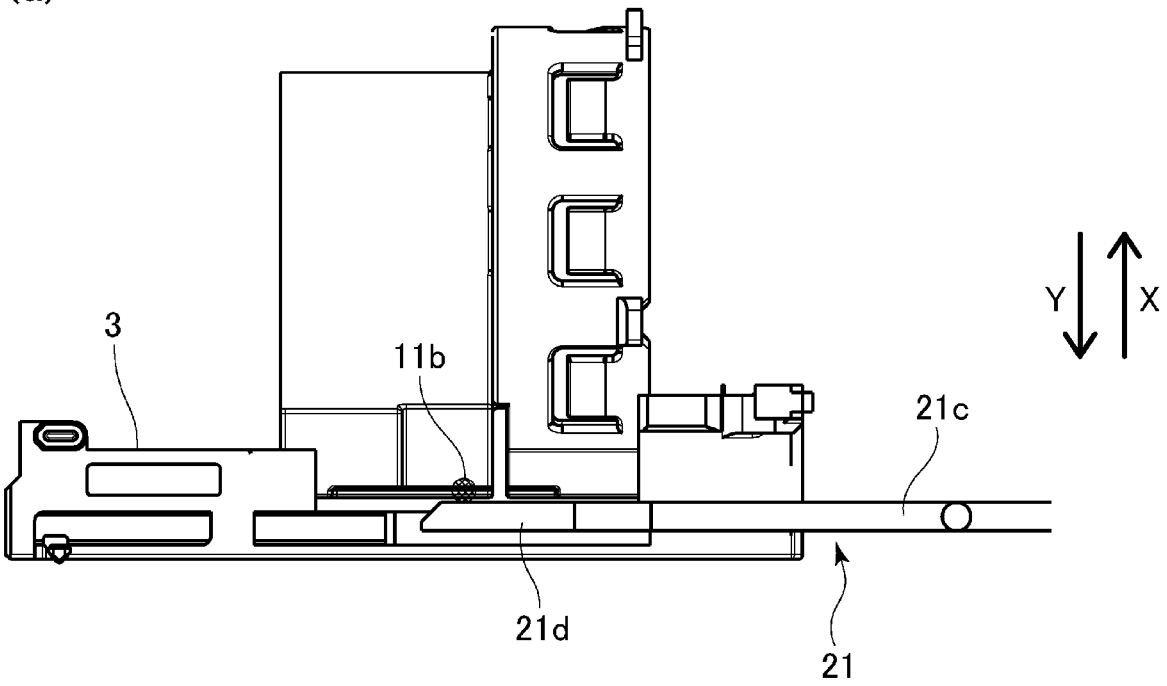
Figure 18:
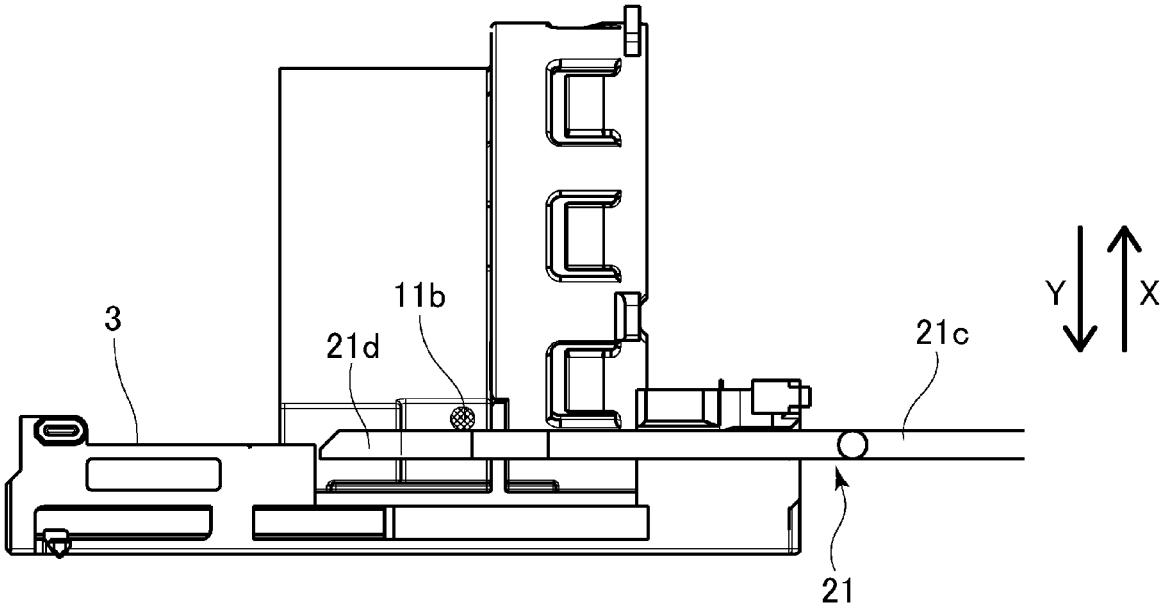

Parts (a) and (b) of FIG. 18 are partial cross-sectional views of the engaged portion and the engaging portion of the developer receiving portion when the manipulating portion is in the first position according to Embodiment 1, part (b) is a partial cross-sectional view of the engaged portion and the engaging portion of the developer receiving portion when the manipulating portion is in the second position.

Figure 19:
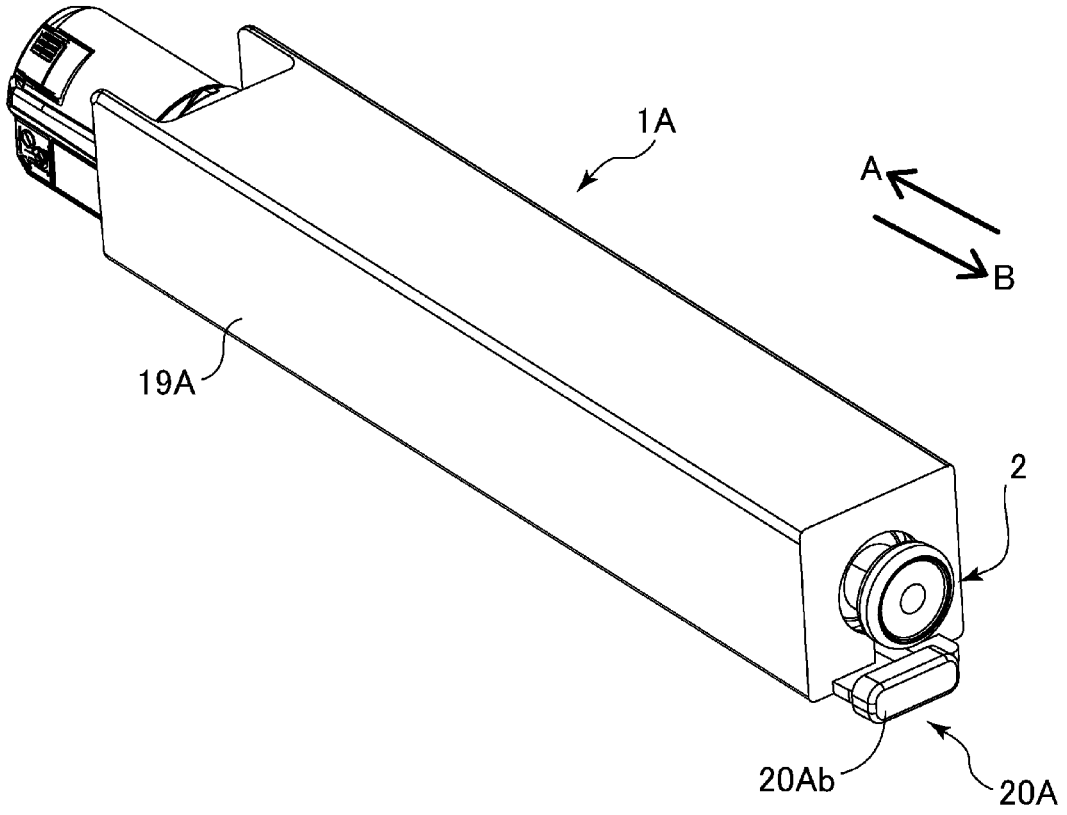

FIG. 19 is a perspective view of the developer supply container according to Embodiment 2.

Figure 20:
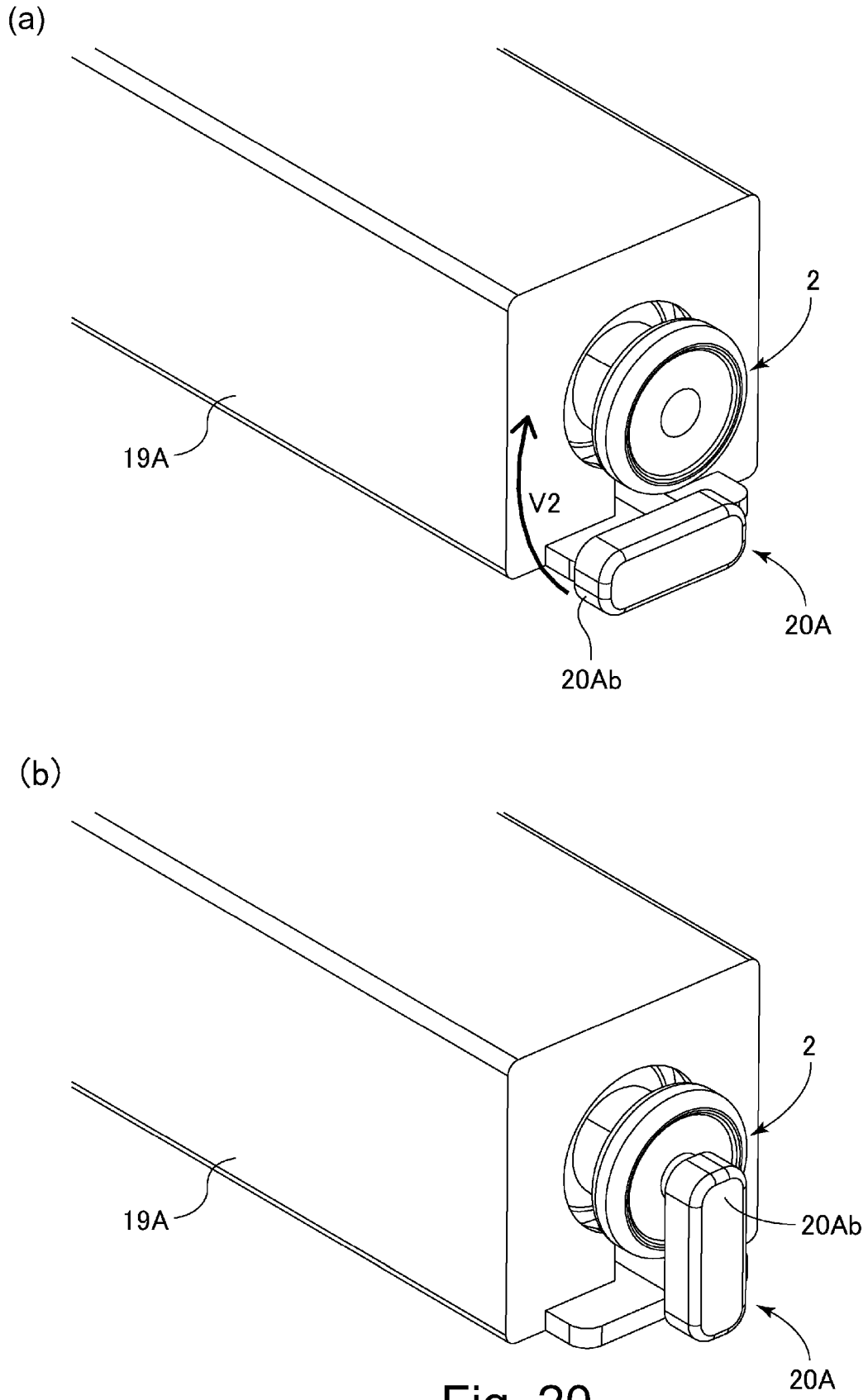

Parts (a) and part (b) of FIG. 20 show a developer supply container according to Embodiment 2, in which part (a) is an end perspective view in a state where the manipulating portion is in the first position, (b) is an end perspective view in a state where the manipulating portion is in the second position.

Figure 21:
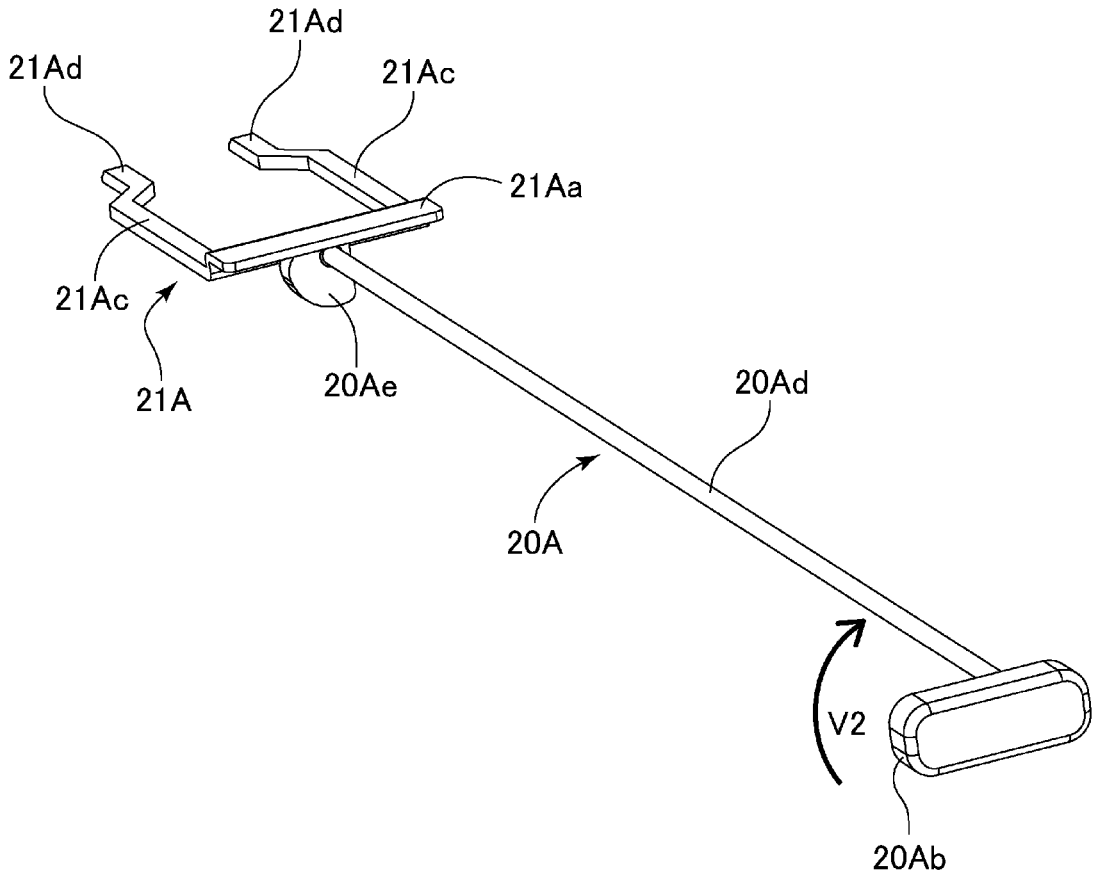

FIG. 21 is a perspective view of the manipulating member and the operation portion according to Embodiment 2.

Figure 22:
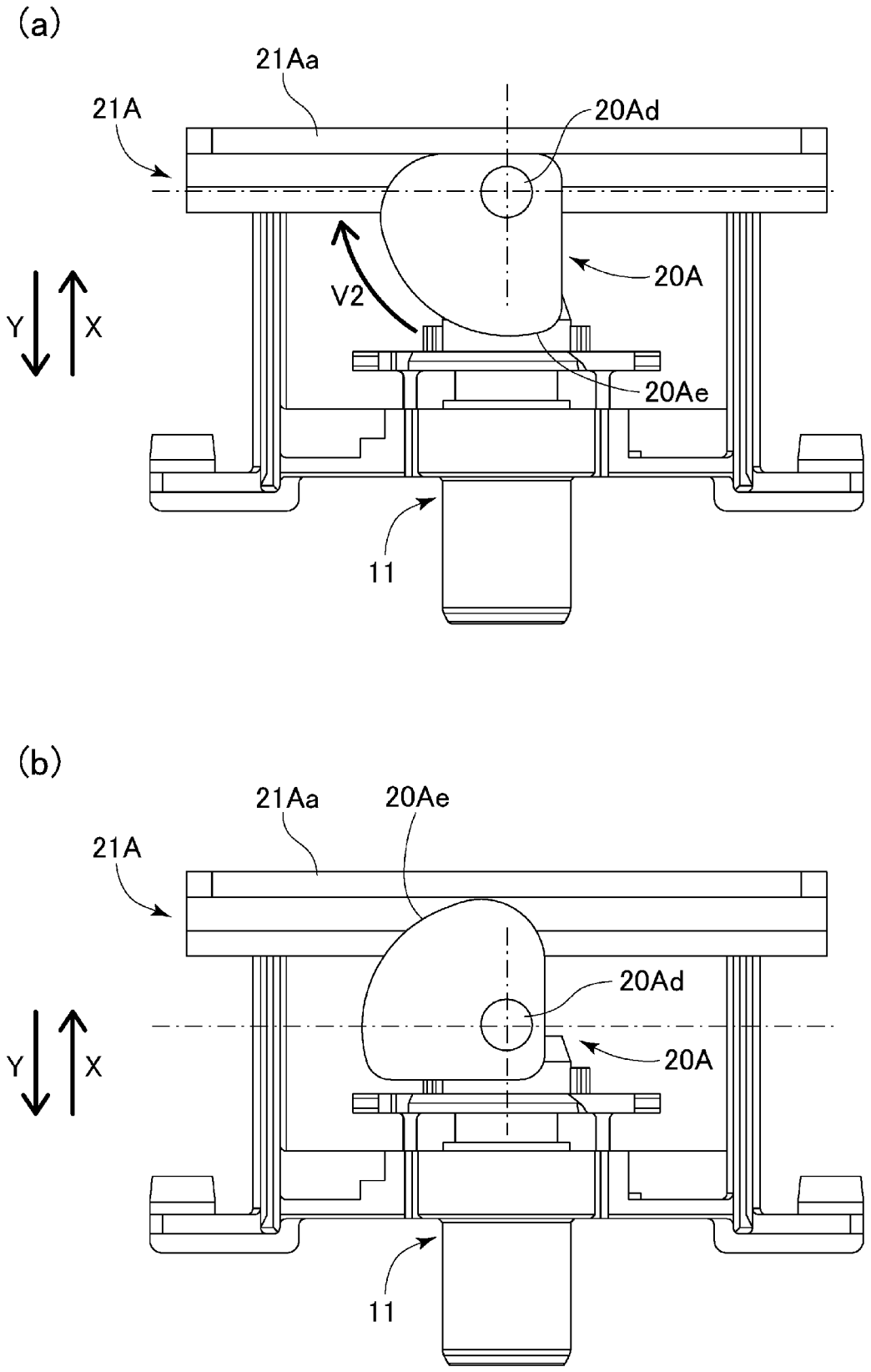

Parts (a) and (b) of FIG. 22 show the developer receiving portion according to Embodiment 2, in which part (a) is an enlarged view of a neighborhood of a cam portion and a developer receiving portion when the manipulating portion is in the first position, and part (b) is an enlarged view of a neighborhood of the cam portion and a developer receiving portion when the manipulating portion is in the second position.

Figure 23:
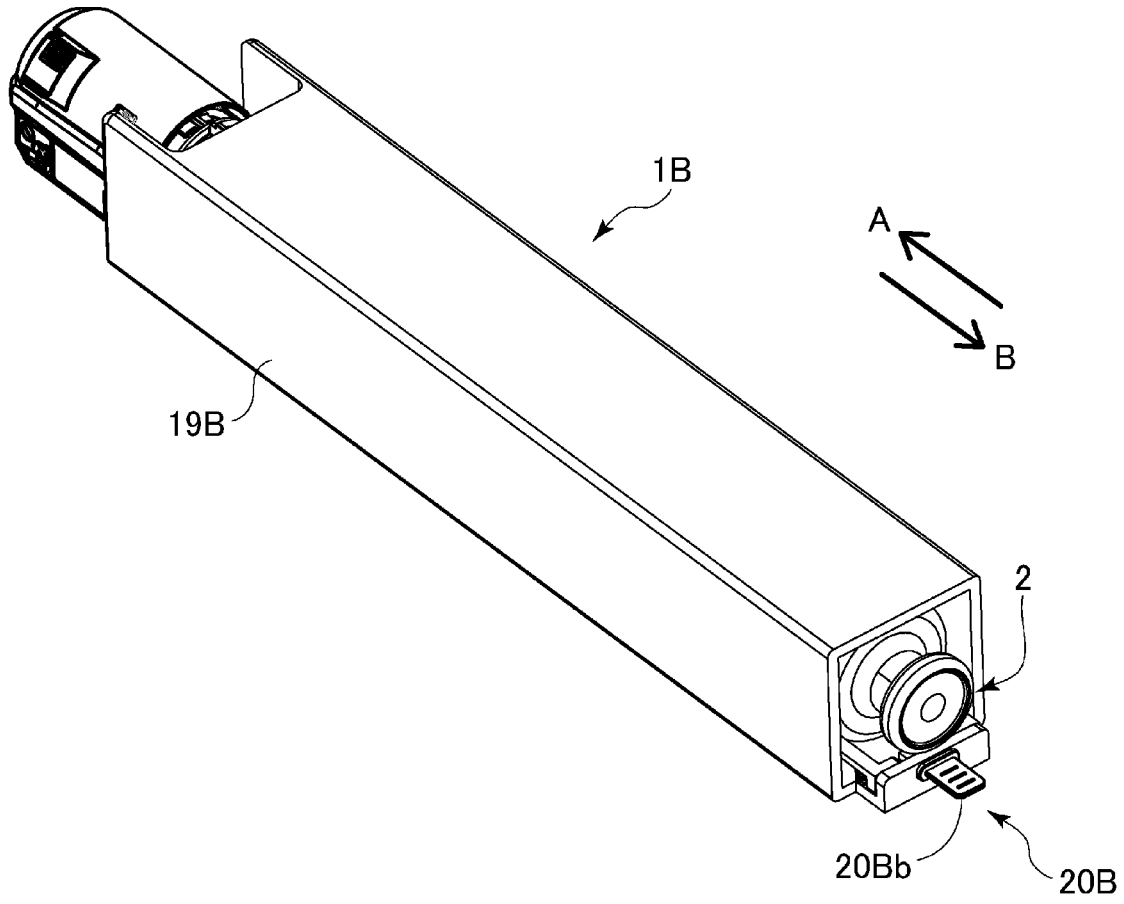

FIG. 23 is a perspective view of the developer supply container according to Embodiment 3.

Figure 24:
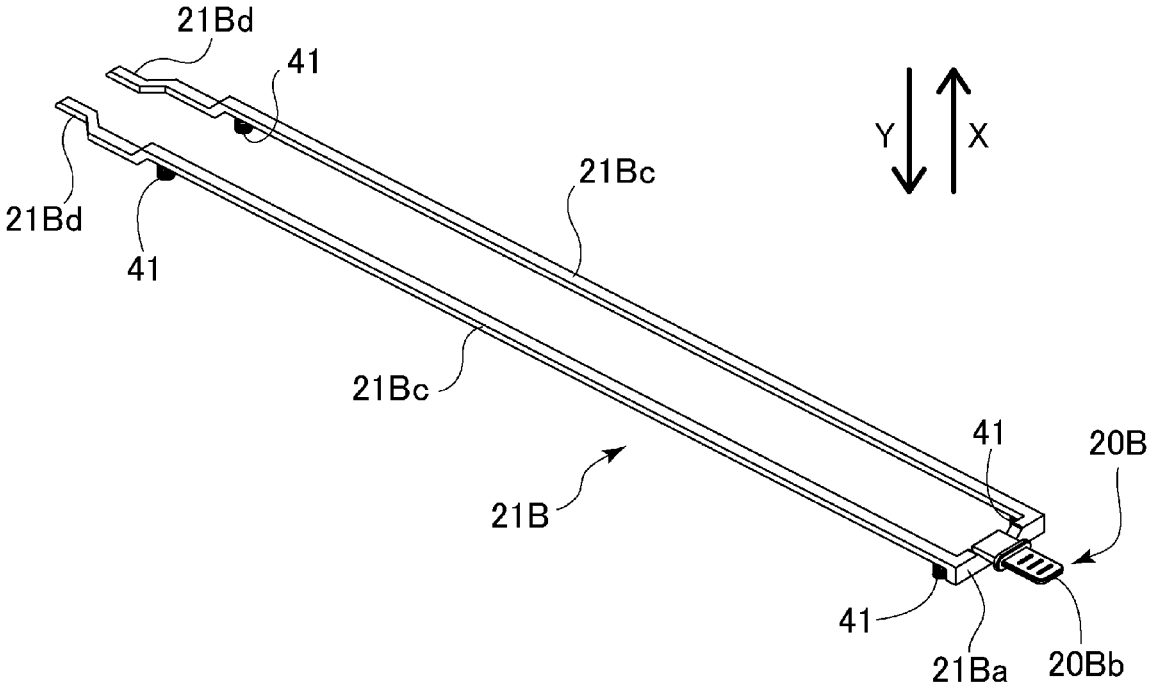
Figure 24:
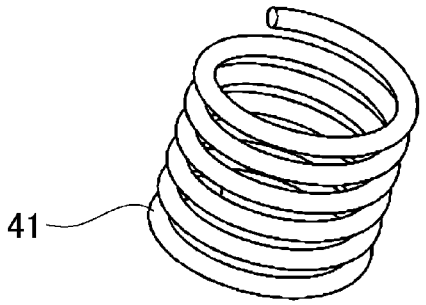

Part (a) and (b) of FIG. 24 show the operating member and the manipulating portion according to Embodiment 3, in which part (a) is a perspective view of the operating member and the manipulating portion, and part (b) is a perspective view of a compression spring.

Figure 25:
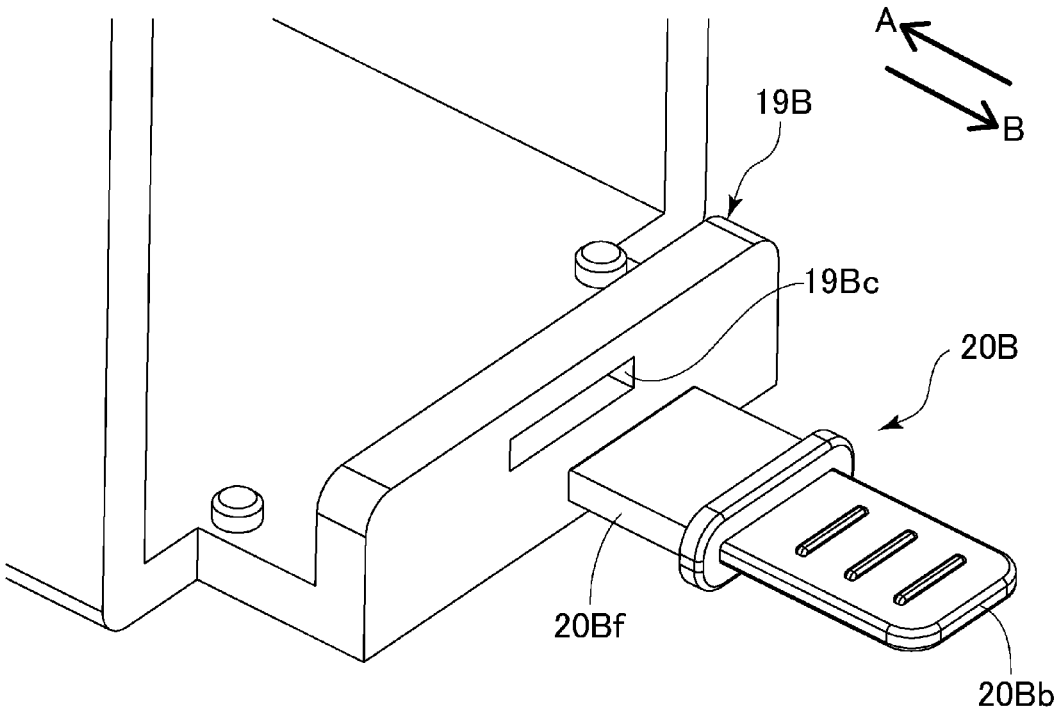

FIG. 25 is a perspective view of an end portion and a manipulating portion of the cover member of the developer supply container according to Embodiment 3.

Figure 26:
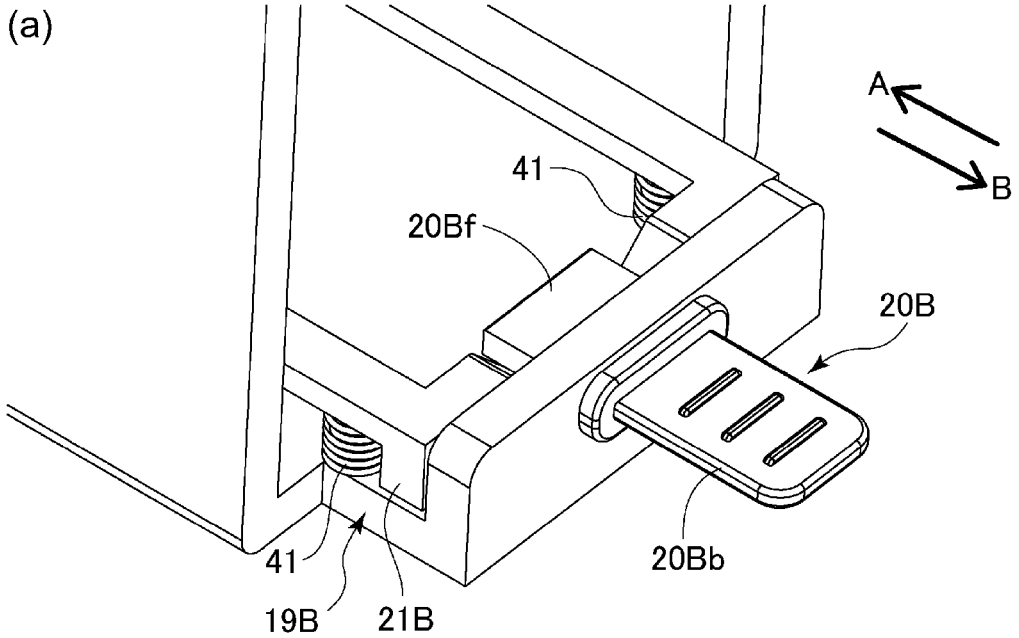
Figure 26:
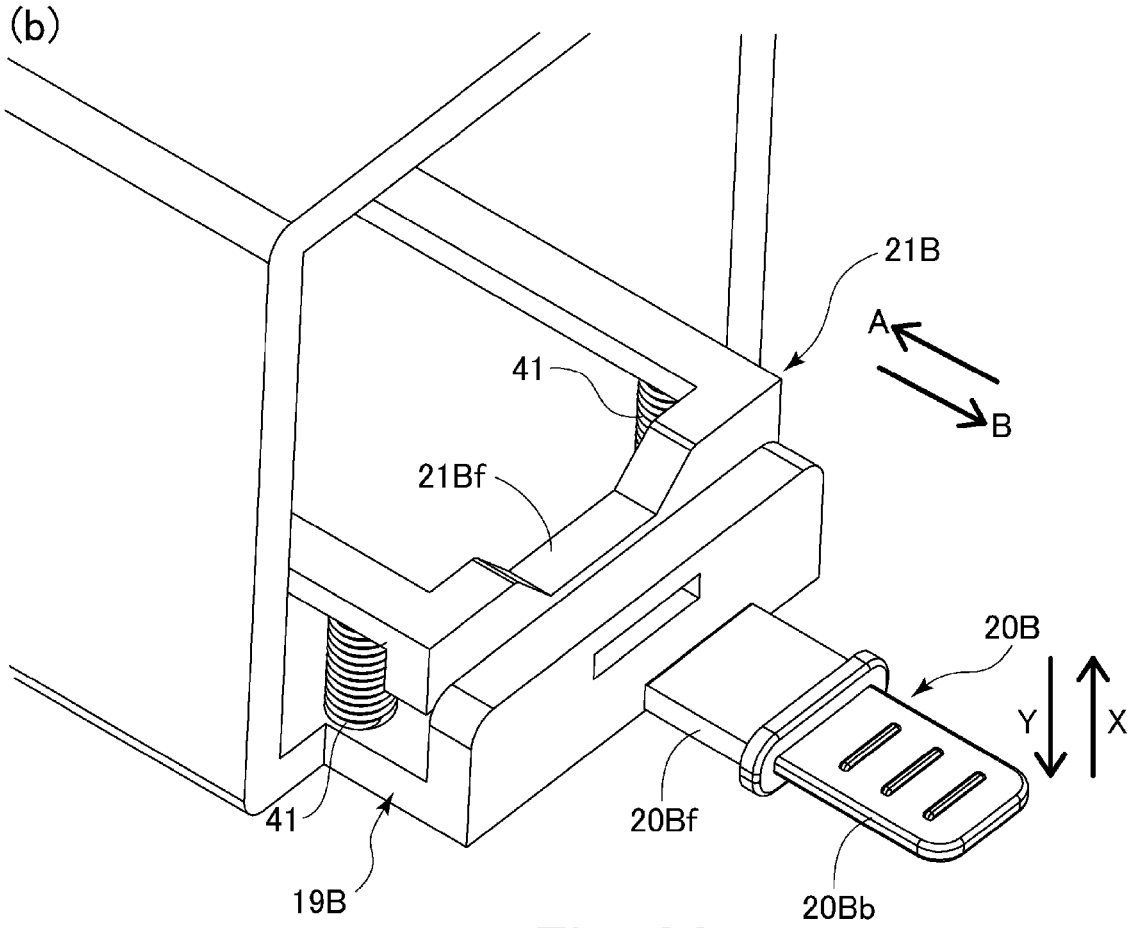

Part (a) and part (b) of FIG. 26 show a developer supply container according to Embodiment 3, wherein part (a) of FIG. 26 is a partial enlarged view illustrating a state in which the manipulating portion and the operating member are in the first positions, and (b) is a partial enlarged view of a state in which the manipulating portion and the operating member are in the second position.

Figure 27:
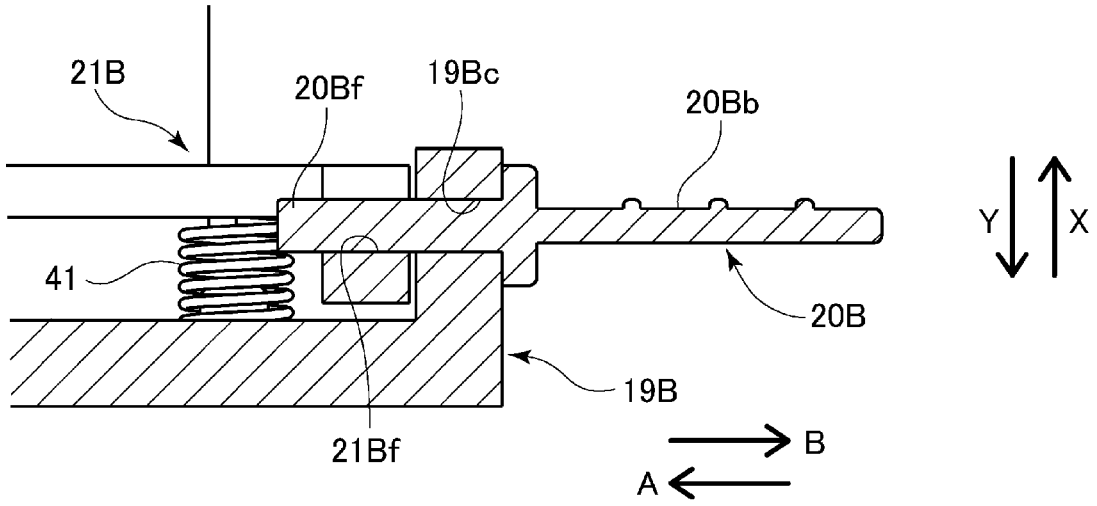
Figure 27:
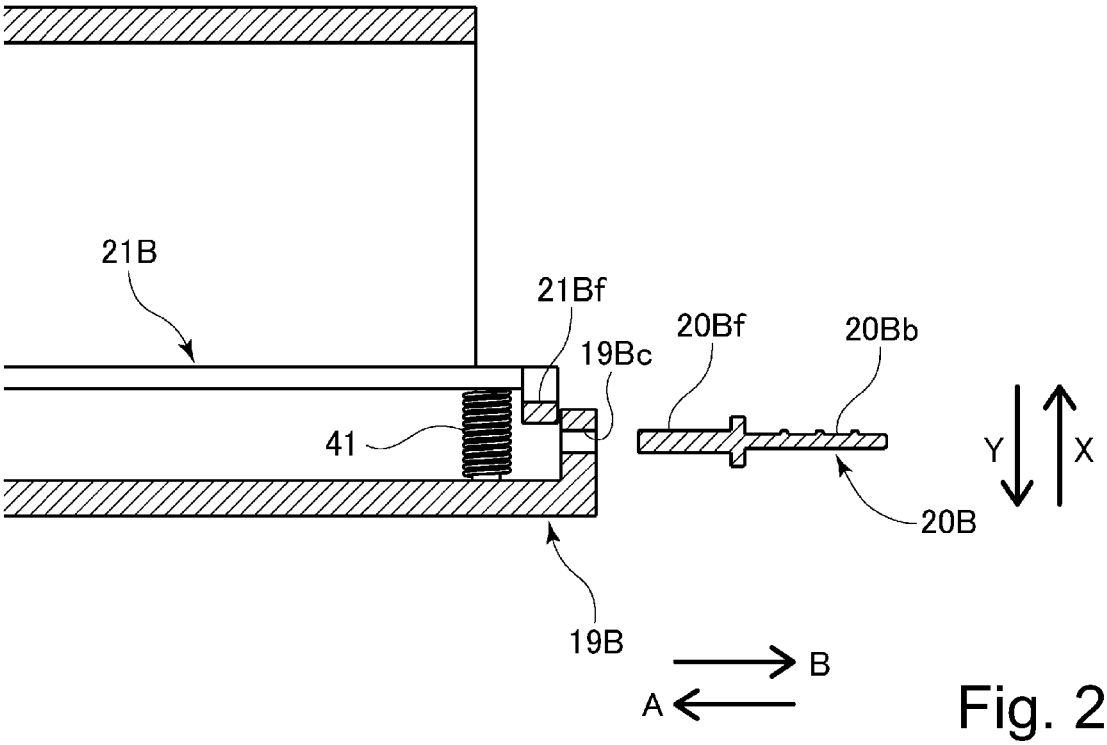

Parts (a) and (b) of FIG. 27 show the manipulating portions according to Embodiment 3, wherein part (a) of FIG. 27 is a partial cross-sectional view in the neighborhood of the manipulating portion in a state where the manipulating portion is in the first position, and part (b) of FIG. 27 is a partial cross-sectional view in the neighborhood of the manipulating portion in a state where the operating portion is in the second position.

Figure 28:
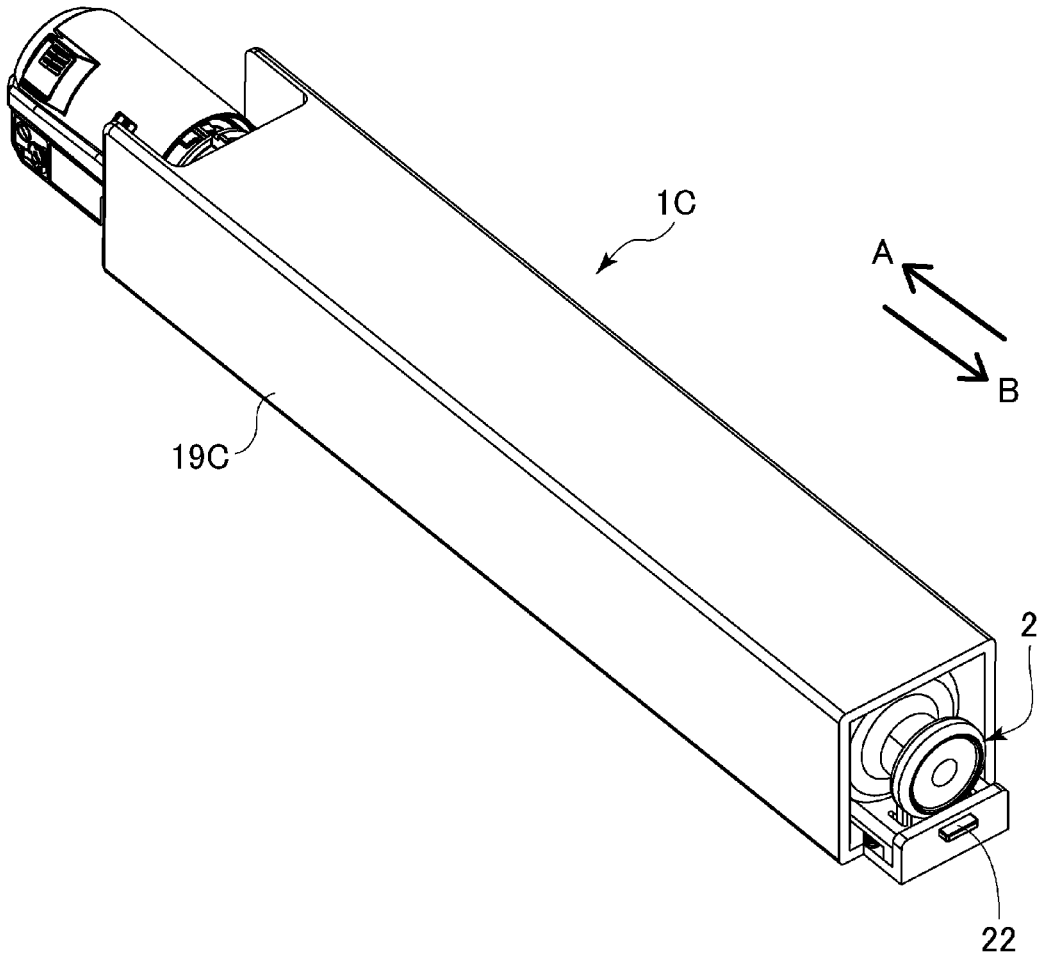

FIG. 28 is a perspective view of the developer supply container according to Embodiment 4.

Figure 29:
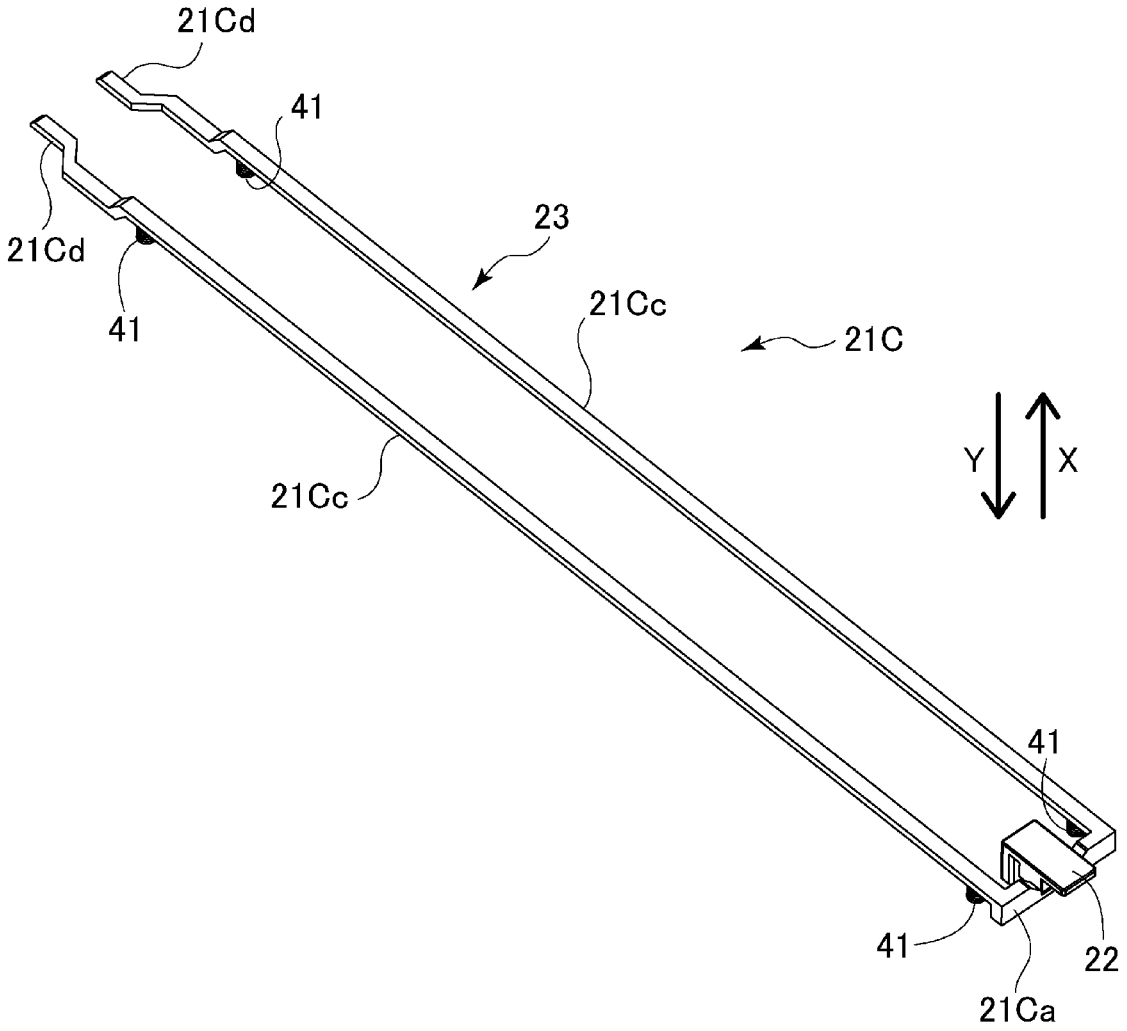

FIG. 29 is a perspective view of the operating member according to Embodiment 4.

Figure 30:
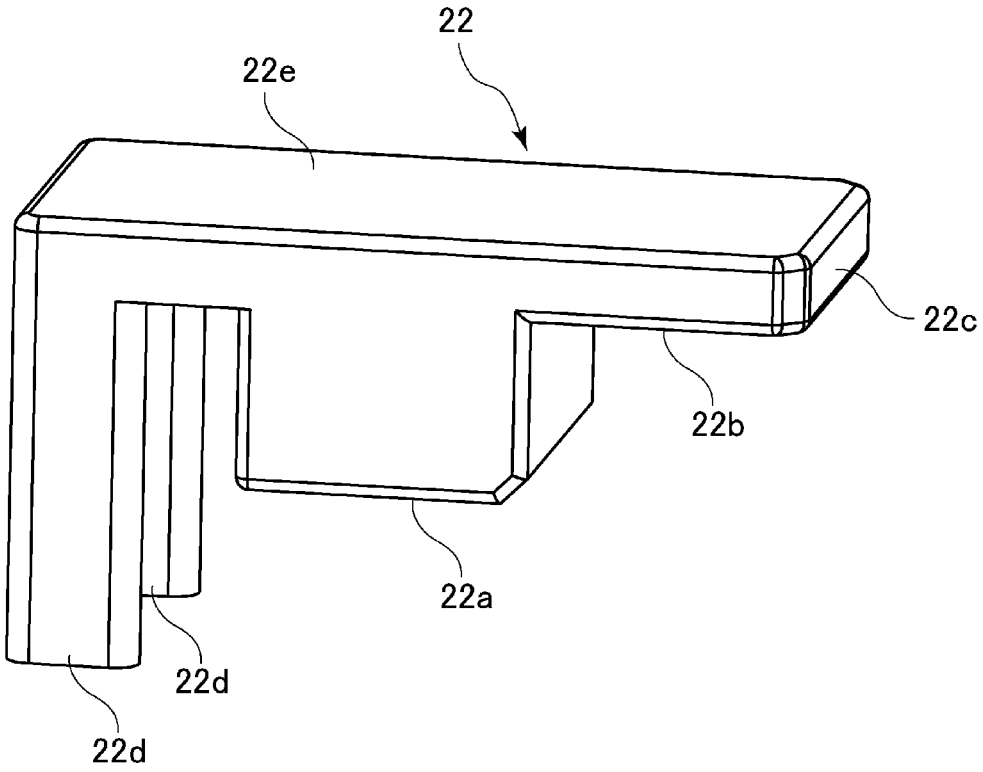

FIG. 30 is a perspective view of the second regulating portion according to Embodiment 4.

Figure 31:
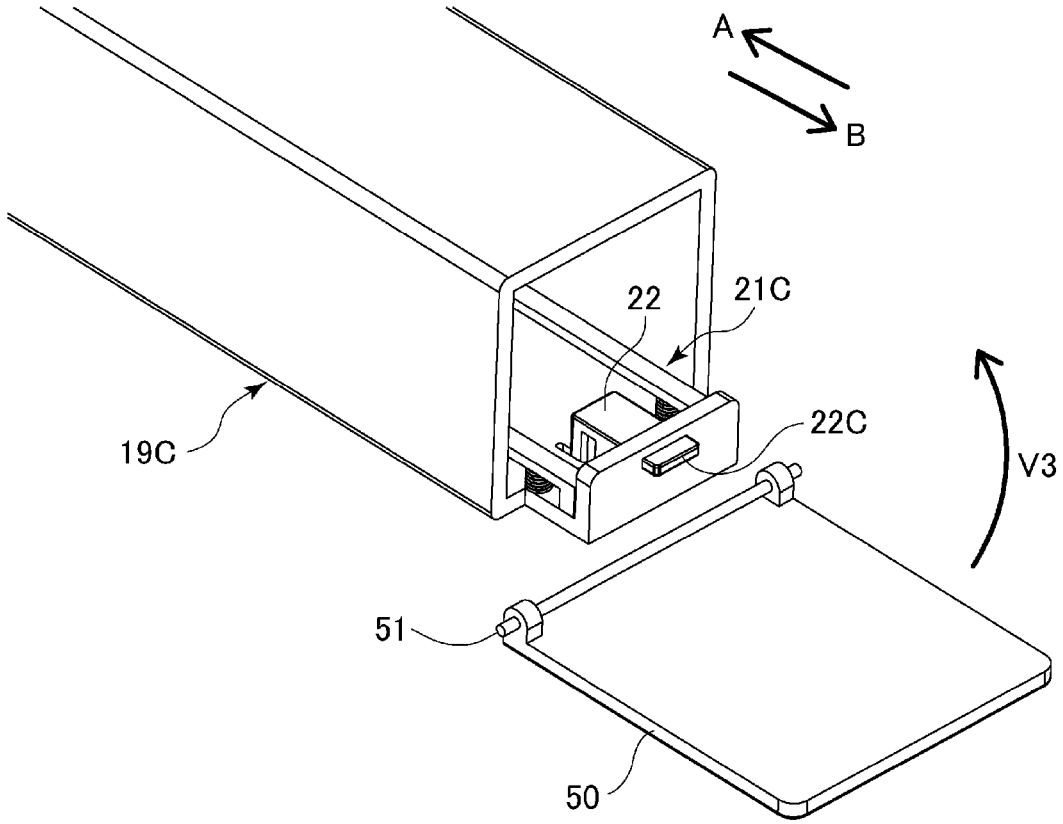
Figure 31:
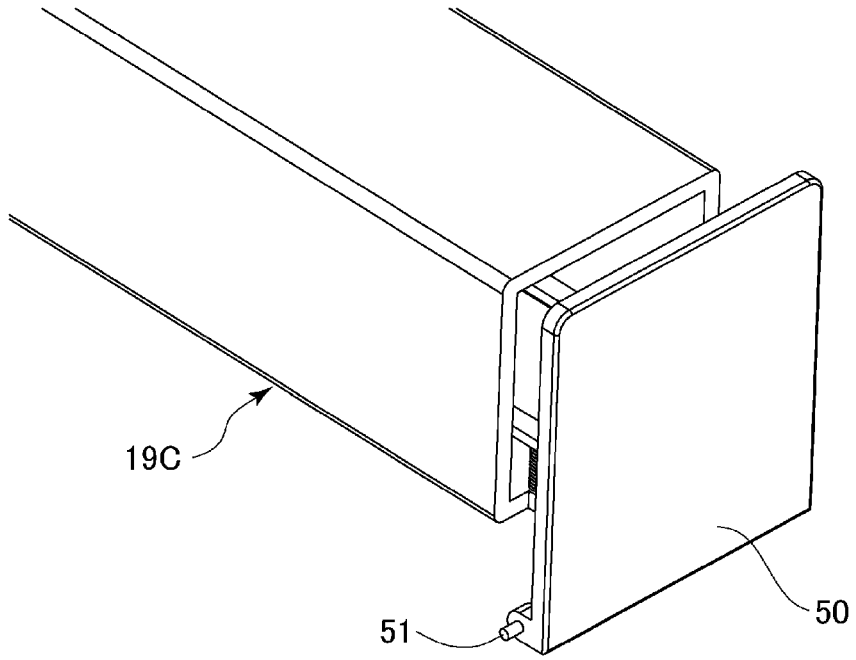

Part (a) and (b) of FIG. 31 show the developer supply container according to Embodiment 4, wherein part (a) of FIG. 31 shows a state when the openable cover is opened and part (b) is a perspective view of a portion of the end portion side of the developer supply container and the opening and closing cover when the openable cover is closed.

Figure 32:
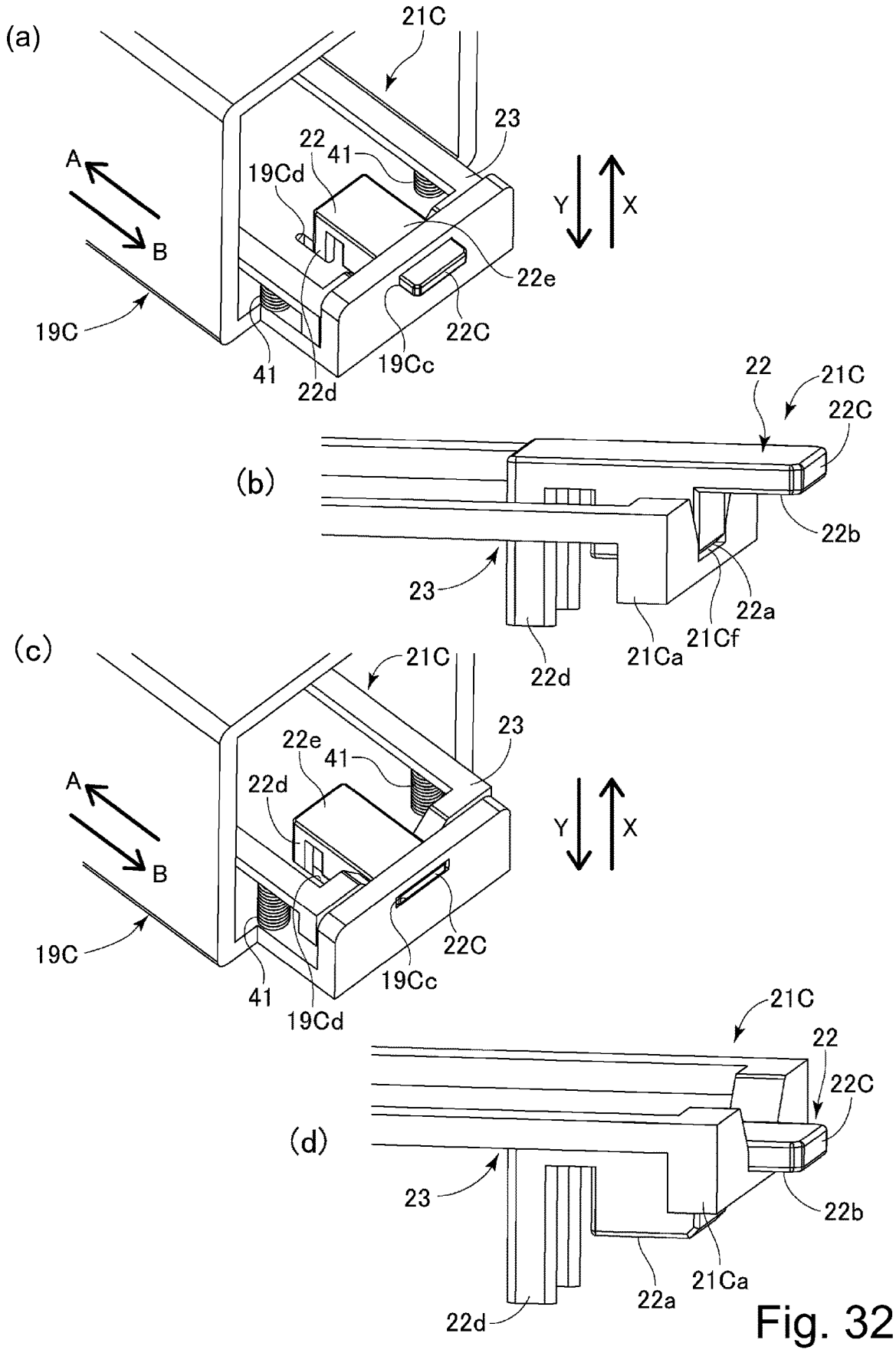

Part (a), (b), (c) and (d) of FIG. 32 show the developer supply container according to Embodiment 4, wherein part (a) is a perspective view of a part of the end portion of the developer supply container (b) is a perspective view illustrating a part of (a), part (c) is a perspective view of a part of the end portion of the developer supply container when the open/close cover is closed, and (d) is a perspective view illustrating a part of (c).

Figure 2:
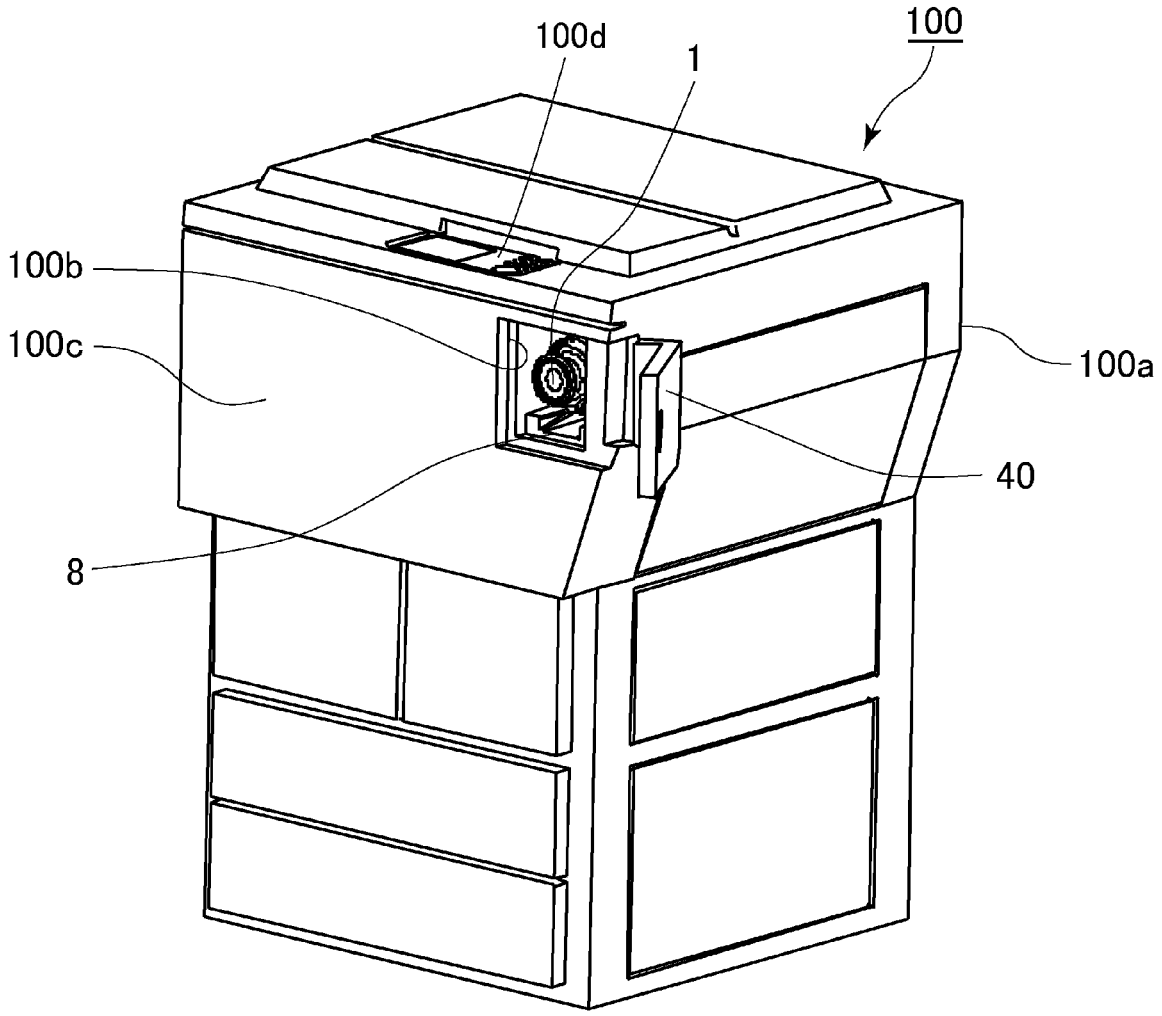
FIG. 2 is a perspective view of the image forming apparatus according to Embodiment 1.
Figure 33:
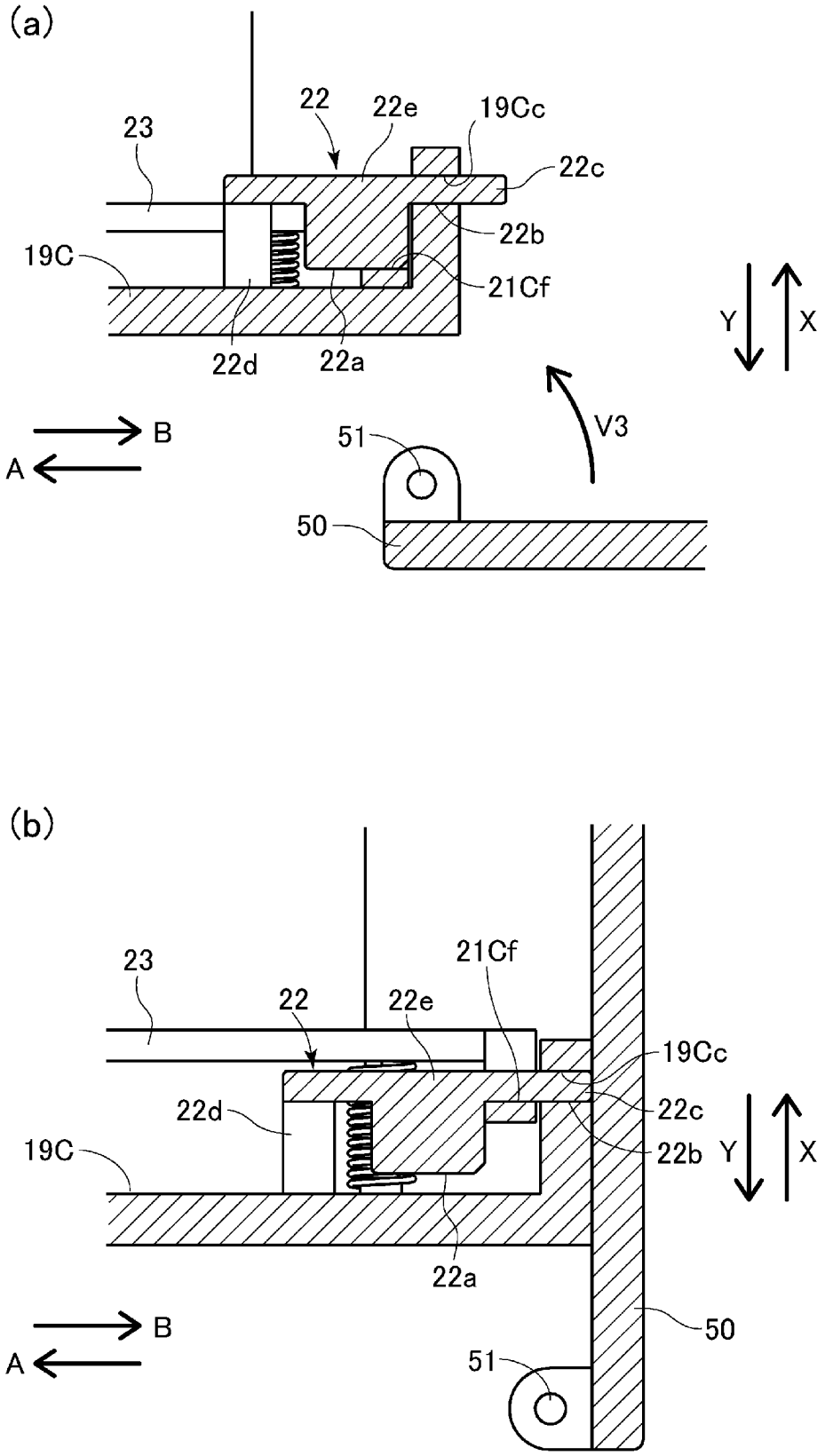

Parts (a) and (b) of FIG. 33 relate to Embodiment 4, in which (a) is a partial cross-sectional view of an operating member and an opening/closing cover when the opening and closing cover is opened, (b) an operation when the opening and closing cover is closed FIG. 2 is a partial cross-sectional view of a member and an opening/closing cover.

DESCRIPTION OF THE EMBODIMENTS

Embodiment 1

In the following, referring to FIGS. 1-18, Embodiment 1 of the present invention will be described. First, referring to FIG. 1 and FIG. 2, a schematic structure of the image forming apparatus of this embodiment will be described.

[Image Forming Apparatus]

Figure 1:
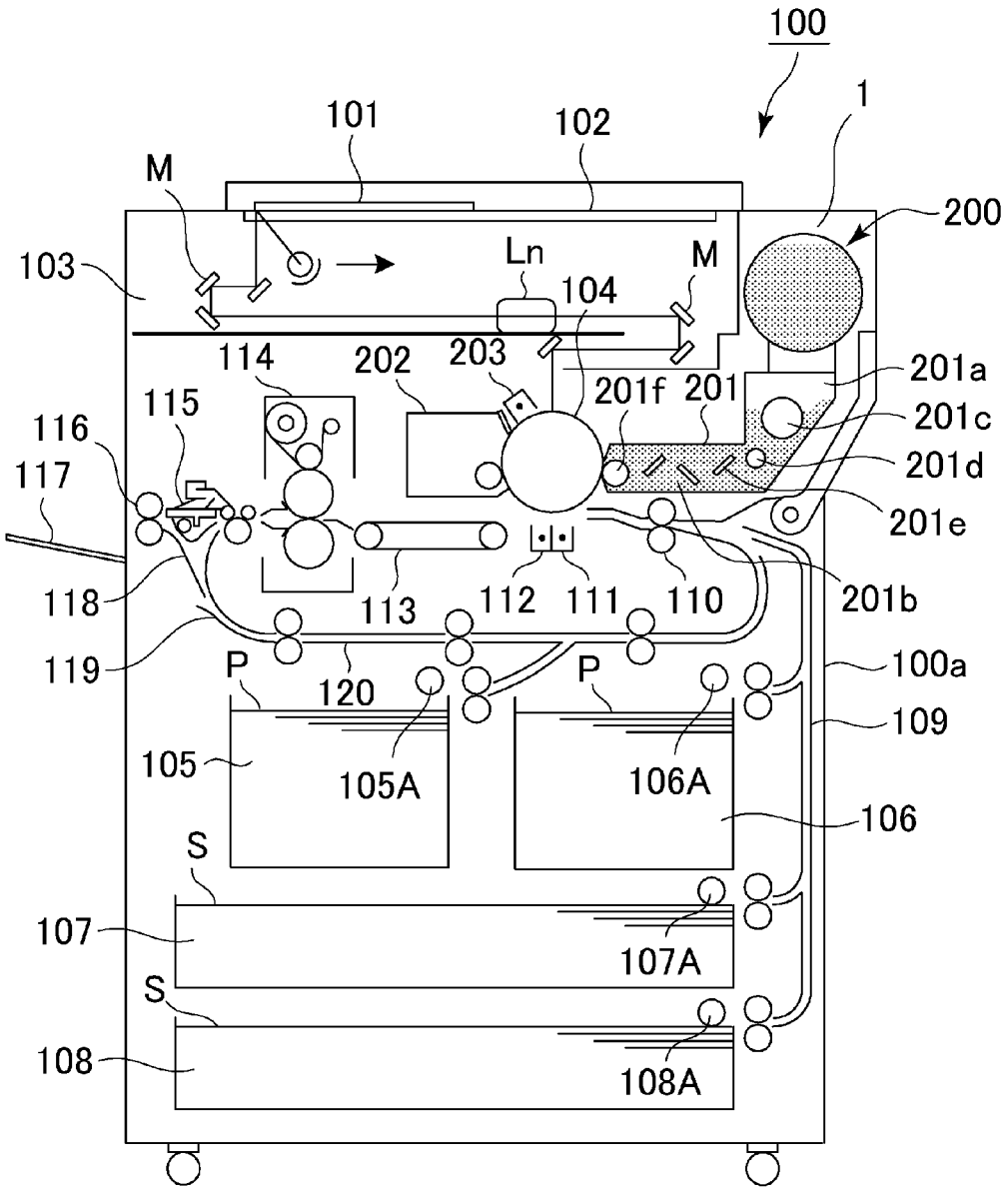
FIG. 1 shows a schematic structure diagram of an image forming apparatus according to Embodiment 1.

In FIG. 1, the image forming apparatus 100 includes an original reading device 103 at a top of a main assembly 100*a* of the image forming apparatus. An original 101 is placed on an original platen glass 102. A light image corresponding to image information of the original 101 is imaged, using a plurality of mirrors M and the lens Ln of the original reading device 103, on a photosensitive drum 104 which is a cylindrical photosensitive member as an image bearing member to form an electrostatic latent image. This electrostatic latent image is visualized using toner (one component magnetic toner) as a developer (dry powder) by a dry type developing device (one-component developing device) 201. Here, in this embodiment, a one-component magnetic toner is used as the developer to be supplied from the developer supply container 1 (also referred to as a toner cartridge), but the present invention is not limited to such an example, and it may be of a structure as will be described hereinafter.

More specifically, in the case of using a one-component developing device which performs developing operation with one component nonmagnetic toner, one component nonmagnetic toner is supplied as a developer. In addition, non-magnetic toner is supplied as the developer when using a two-component developer which develops the image using a two component developer prepared by mixing magnetic carrier and nonmagnetic toner. In this case, as the developer, a structure may be employed in which the magnetic carrier is also supplied together with the non-magnetic toner.

As described above, a developing device 201 shown in FIG. 1 develops the electrostatic latent image formed on the photosensitive drum 104 using the toner as the developer based on the image information of the original 101. In addition, a developer supplying system 200 is connected to developing device 201, and the developer supplying system 200 includes a developer supply container 1 and a developer receiving apparatus 8 relative to which the developer supply container 1 is mountable and dismountable. Developer supplying system 200 will be described hereinafter.

The developing device 201 includes a developer hopper portion 201*a* and a developing roller 201*f*. In this developer hopper portion 201*a*, a stirring member 201*c* for stirring the developer supplied from the developer supply container 1 is provided. The developer stirred by the stirring member 201*c* is fed to a feeding member (201*e*) side by a feeding member 201*d*. And, the developer which has been sequentially fed by the feeding members 201*e* and 201*b* is carried on the developing roller 201*f* and finally supplied to a developing zone where it is opposed to the photosensitive drum 104. In this embodiment, a one-component developer is used, and therefore, toner as a developer from the developer supply container 1 is supplied to the developing device 201, but when using a two component developer, toner and carrier as a developer may be supplied from the developer supply container.

Cassettes 105 to 108 contain recording materials S such as sheets of paper. When an image is to be formed, a cassette containing an optimum recording material S among the sheets contained in these cassettes 105 to 108 is selected on the basis of the information inputted by the operator (user or service person) on the operation portion 100*d* of the image forming apparatus 100 or on the basis of the size of the original 101. Here, as for the recording material S, it is not limited to sheets of paper, but it may be an OHP sheet or the like as the case may be. One sheet of recording material S fed by the feeding and separating devices 105A to 108A is fed to registration rollers 110 by way of a feeding portion 109. Then, the recording material S is fed in synchronization with the rotation of the photosensitive drum 104 and the scan timing of the original reading device 103.

A transfer charging device 111 and a separation charging device 112 are provided at positions opposing the photosensitive drum 104 on a downstream side of the registration roller 110 in the recording material feeding direction. The image of the developer (toner image) formed on the photosensitive drum 104 is transferred onto the recording material S fed by the registration roller 110, by a transfer charging device 111. And, the recording material S onto which the toner image is transferred is separated from the photosensitive drum 104 by a separation charging device 112. Subsequently, heat and pressure are applied to the recording material S fed by the feeding portion 113 in a fixing portion 114, so that the toner image is fixed on the recording material. Thereafter, the recording material S to which the toner image is fixed passes through a discharge/reversing portion 115 and is discharged to the discharge tray 117 by the discharge roller 116, in case of single-sided copy.

On the other hand, in case of double-sided copy, the recording material S passes through the discharge/reversing portion 115, and the recording material S is partly discharged to the outside of the apparatus once by the discharge roller 116. After this, at the timing when a trailing end of the recording material S passes through the switching member 118 and is still nipped by the discharge rollers 116, the position of the switching member 118 is switched, and the discharge roller 116 is rotated counterclockwise, by which the recording material S is fed again into the apparatus. Thereafter, the recording material S is fed to the registration roller 110 by way of the re-feeding and feeding portions 119 and 120, and is discharged to the discharge tray 117 by way of the same path as in the case of single-sided copying.

In the image forming apparatus 100 having the above-described structure, image forming process devices such as a developing device 201, a cleaner portion 202, a primary charging device 203 and the like are provided around the photosensitive drum 104. Here, the developing device 201 supplies the developer to the electrostatic latent image formed on the photosensitive drum 104 on the basis of the image information of the original 101 read by the original reading device 103 so as to develop the electrostatic latent image. In addition, the primary charging device 203 uniformly charges the surface of the photosensitive drum to form a desired electrostatic latent image on the photosensitive drum 104. Furthermore, the cleaner portion 202 has a function of removing the developer remaining on the photosensitive drum 104.

As shown in FIG. 2, when the operator opens a opening/closing cover 40 which is a portion of an outer cover of the apparatus main assembly 100*a* of the image forming apparatus 100, a part of the developer receiving apparatus 8 which will be described hereinafter can be seen. And, by inserting the developer supply container 1 into this developer receiving apparatus 8, the developer supply container 1 is mounted in a state where it can supply the developer to the developer receiving apparatus 8. That is, the developer supply container 1 is mounted to the developer receiving apparatus 8 through the opening 100*b* of the apparatus main assembly 100*a* provided with the developer receiving apparatus 8. The opening/closing cover 40 can open and close the opening 100*b*. On the other hand, when the operator exchanges the developer supply container 1, it carries out the operation opposite to the loading operation, by which the developer supply container 1 is dismounted from the developer receiving apparatus 8, and thereafter a new developer supply container 1 can be mounted. Here, the opening/closing cover 40 is a cover exclusively for mounting/dismounting (exchanging) the developer supply container 1, and is opened and closed only for dismounting/mounting the developer supply container 1. On the other hand, the maintenance operation for the image forming apparatus 100 is performed by opening/closing a front cover 100*c*. Here, the opening/closing cover 40 and the front cover 100*c* may be integrated. In such a case, the replacement of the developer supply container 1 and the maintenance of the image forming apparatus 100 are performed by opening and closing the integrated cover (not shown).

[Developer Receiving Apparatus]

Next, referring to part (a) of FIG. 3 to FIG. 5, the developer receiving apparatus 8 constituting the developer supplying system 200 will be described. As shown in part (a) of FIG. 3, the developer receiving apparatus 8 is provided with a mounting portion (mounting space) 8*f* to which the developer supply container 1 is dismountably mounted. The mounting portion 8*f* is provided with an insertion guide 8*e* for guiding the developer supply container 1 in the mounting and dismounting directions. In the case of this embodiment, the structure is such that the mounting direction of the developer supply container 1 is the direction indicated by A, and the dismounting direction B of the developer supply container 1 is opposite to the direction A of mounting the developer supply container 1, by the insertion guide 8*e*.

As shown in part (a) of FIG. 3 to part (a) of FIG. 4, the developer receiving apparatus 8 has a drive gear 9 which functions as a driving mechanism for driving the developer supply container 1. A rotational driving force is transmitted to the actuating gear 9 from a driving motor 500 by way of a driving gear train (not shown), so that the actuating gear 9 applies the rotational driving force to the developer supply container 1 mounted in the mounting portion 8*f*. The operation of the driving motor 500 is controlled by the control device 600.

In addition to controlling the driving motor 500, the control device 600 controls overall of the image forming apparatus 100. The control device 600 has a CPU (Central Processing Unit), a ROM (Read Only Memory), and a RAM (Random Access Memory). The CPU controls each portion while reading the program corresponding to a control procedure stored in the ROM. In addition, working data and an input data are stored in the RAM, and the CPU executes control while looking up the data stored in the RAM on the basis of the program etc.

In the mounting portion 8*f* of the developer receiving apparatus 8, there is provided a developer receiving portion 11 for receiving the developer discharged out of the developer supply container 1. The developer receiving portion 11 is connected to a container discharge opening 3*a*4 (part (b) of FIG. 7) of the developer supply container 1 when the developer supply container 1 is mounted, and has a receiving opening 11*a* for receiving the developer discharged through the container discharge opening 3*a*4. The developer receiving portion 11 is mounted so as to be movable (displaceable) in the direction in which the receiving opening 11*a* moves toward and away from the container discharge opening 3*a*4 (in this embodiment, the direction crossing with the direction in which the developer supply container 1 is mounted (more specifically, vertical direction relative to the developer receiving apparatus 8)). In the case of this embodiment, as shown in FIG. 5, the developer receiving portion 11 is urged by an urging member (spring) 12 as urging means in a direction in which the receiving opening 11*a* moves away from the container discharge opening 3*a*4 (vertically downward). That is, the urging member 12 urges the developer receiving portion 11 in a direction opposite to the direction in which it displaces in accordance with the mounting operation of the developer supply container 1. Therefore, when the receiving opening 11*a* moves toward the container discharge opening 3*a*4 (upward in the vertical direction), the developer receiving portion 11 moves against the urging force of the urging member 12.

In addition, as shown in part (a) of FIG. 4, a first shutter stopper portion 8*a* and a second shutter stopper portion 8*b* are provided on the mounting portion 8*f* of the developer receiving apparatus 8 in the upstream side, in the mounting direction (direction of arrow A), of the developer receiving portion 11. In the developer supply container 1 which is moving relative to the developer receiving apparatus 8 during mounting and dismounting, the first and second shutter stopper portions 8*a* and 8*b* restrict relative movement of the shutter 4 only (part (a) of FIG. 9 and the like) with respect to the developer receiving apparatus 8, which will be described later. In this case, the shutter 4 moves relative to a portion of the developer supply container 1 other than the shutter 4, such as the container body 2 and the like which will be described later.

As shown in part (b) of FIG. 3 and part (b) of FIG. 4, below the developer receiving apparatus 8 in the vertical direction, a sub hopper 8*c* for temporarily storing the developer supplied from the developer supply container 1 is provided. In this sub hopper 8*c*, a feeding screw 14 for feeding the developer to a developer hopper portion 201*a* (FIG. 1) which is a portion of the developing device 201, and an opening 8*d* communicating with the developer hopper portion 201*a* are provided.

As shown in part (c) of FIG. 4 and FIG. 5, a main assembly seal 13 formed so as to surround the receiving opening 11*a* is provided in the developer receiving portion 11. The main assembly seal 13 comprises an elastic member, foam and so on. With the developer supply container 1 mounted, the main assembly seal 13 and an opening seal 3*a*5 (part (b) of FIG. 7) surrounding the container discharge opening 3*a*4 of the developer supply container 1 sandwich the shutter 4 in close contact therewith. By this, the developer discharged from the container discharge opening 3*a*4 of the developer supply container 1 through the shutter opening 4*j* (discharge port) of the shutter 4 to the receiving opening 11*a* is prevented from leaking out of the receiving opening 11*a* (developer feed path).

Here, it is desirable that a diameter of the receiving opening 11*a* is substantially the same as or slightly larger than a diameter of the shutter opening 4*j* of the shutter 4, in order to prevent the interior of the mounting portion 8*f* from being contaminated by the developer. This is because if the diameter of the receiving opening 11*a* is smaller than the diameter of the shutter opening 4*j*, the developer discharged from the shutter opening 4*j* is more likely to be deposited on the upper surface of the main assembly seal 13. If the developer is deposited on the lower surface of the developer supply container 1 at the time of mounting/dismounting operation of the developer supply container 1, it becomes a cause of contamination by the developer. In view of this point, it is preferable that the diameter of the receiving opening 11*a* is roughly the same as or about 2 mm larger than the diameter of the shutter opening 4*j*. For example, in the case that the diameter of the shutter opening 4*j* of the shutter 4 is a fine hole (pinhole) of about 2 mm in diameter, it is preferable that the diameter of the receiving opening 11*a* is about 3 mm.

In addition, as shown in part (c) of FIG. 4 and FIG. 5, on the side surface of the developer receiving portion 11, an engaged portion (portion to be engaged) 11*b* projecting toward the center side is provided. In the case of this embodiment, the engaged portion 11*b* is directly engaged with an engaging portion 21*d* (FIG. 17 and so on) provided in the developer supply container 1 which will be described hereinafter. And, the engaging portion 21*d* engages with the engaged portion 11*b* by the operating portion 21 performing a predetermined operation, so that the developer receiving portion 11 lifts upward in the vertical direction toward the developer supply container 1.

[Developer Supply Container]

Next, referring to part (a) FIG. 6 to part (b) of FIG. 18, the developer supply container 1 constituting the developer supplying system 200 will be described. First, referring to FIG. 6 through part (b) of FIG. 7, the basic structure of the developer supply container 1 (the structure except for the cover member 19, manipulating portion 20, operating portion and so on which will be described hereinafter) will be described. The developer supply container 1 mainly includes the container body 2, a flange portion 3, the shutter 4, a pump portion 5, a reciprocating member 6, and a cover 7. The developer supply container 1 supplies the developer to the developer receiving apparatus 8 by rotating in the developer receiving apparatus 8 in the direction indicated by an arrow R about the rotation axis P shown in FIG. 8. In the following, each element constituting the developer supply container 1 will be described in detail.

[Container Body]

As shown in FIG. 8, the container body 2 mainly comprises a developer accommodating portion 2*c* for containing the developer. In addition, the container body 2 is provided with a helical feeding groove 2*a* (feeding portion) for feeding the developer in the developer accommodating portion 2*c* by rotating the container body 2 in the direction of the arrow R around the rotation axis P. In addition, as shown in FIG. 8, a cam groove 2*b* and a drive receiving portion 2*d* for receiving a driving force from the main assembly side are integrally formed over the entire periphery of the outer circumferential surface of the container body 2 on one end side. Here, in this embodiment, the cam groove 2*b* and the drive receiving portion (gear) 2*d* are integrally formed with the container body 2, but the cam groove 2*b* or the drive receiving portion 2*d* may be formed as a separate member and may be integrally mounted to the container body 2. In addition, in this embodiment, for example, a toner including a volume average particle diameter of 5 μm to 6 μm is accommodated in the developer accommodating portion 2*c* as the developer. In addition, in this embodiment, the developer accommodating portion 2*c* includes not only the container body 2 but also the interior spaces of the flange portion 3 and the pump portion 5 which will be described hereinafter.

[Flange Portion]

Referring to part (a) and part (b) of FIG. 7, the flange portion 3 will be described. The flange portion 3 is mounted so as to be rotatable relative to the container body 2 about the rotation axis P. And, when the developer supply container 1 is mounted to the developer receiving apparatus 8, the flange portion 3 is held so as not to rotate in the arrow R direction relative to the mounting portion 8*f* (part (a) of FIG. 3). In addition, as shown in part (b) of FIG. 7, a container discharge opening 3*a*4 is provided in a portion of the flange portion 3, and an opening seal 3*a*5 is mounted to the periphery thereof. As shown in parts (a) and (b) of FIG. 5, the flange portion 3 is provided with the pump portion 5, the reciprocating member 6, the shutter 4, and the cover 7.

First, as shown in part (b) of FIG. 7, the pump portion 5 is threaded at one end side of the flange portion 3, and the container body 2 is connected to the other end side with a flange seal 17 therebetween. In addition, a reciprocating member 6 is provided so as to sandwich the pump portion 5, and the engaging projection 6*b* (parts (a) and (b) of FIG. 11) provided on the reciprocating member 6 is engaged with the cam groove 2*b* (FIG. 8). The flange portion 3 is provided with the shutter 4. In this embodiment, the flange portion 3 and the shutter 4 constitute a discharge portion 300 for discharging the developer accommodated in the developer accommodating portion 2*c* out. In addition, the surface on which the shutter 4 is provided is the bottom side of the flange portion 3. In addition, in order to improve the outer appearance and to protect the reciprocating member 6 and the pump portion 5, a cover 7 is integrally provided so as to cover the flange portion 3, the pump portion 5, and the reciprocating member 6 as a whole, as shown in part (b) of FIG. 7.

[Shutter]

Next, referring to parts (a) and (b) of FIG. 9 the shutter 4 will be described. The shutter 4 slidable on the shutter insertion portion 3*d* (part (a) of FIG. 7) of the flange portion 3 move relative to a portion (flange portion 3) of the developer supply container 1. The shutter 4 has a shutter opening 4*j* as a discharge opening, and opens and closes the container discharge opening 3*a*4 (part (b) in FIG. 7) of the developer supply container 1 in accordance with the mounting and dismounting operation of the developer supply container 1. That is, by moving the shutter 4 relative to the developer supply container 1 in accordance with the mounting operation of the developer supply container 1, the receiving opening 11*a* of the developer receiving portion 11 and the shutter opening 4*j* communicate with each other, and in addition with the container discharge opening 3*a*4. By this, the developer in the developer supply container 1 can be discharged to the receiving opening 11*a*. That is, the discharge portion 300 (part (b) of FIG. 5) for discharging the developer is constituted by the flange portion 3 and the shutter 4, and the shutter 4 of the discharge portion 300 is provided with the shutter opening 4*j* as the discharge opening for discharging the developer.

On the other hand, a developer sealing portion 4*a* is provided at a position deviated from the shutter opening 4*j* of the shutter 4. The developer sealing portion 4*a* closes the container discharge opening 3*a*4, and as the shutter 4 moves relative to the developer supply container 1 in accordance with the operation of taking out the developer supply container 1. In addition, the developer sealing portion 4*a* prevents leakage of the developer from the container discharge opening 3*a*4, when the developer supply container 1 is not mounted to the mounting portion 8*f* (part (a) of FIG. 3) of the developer receiving apparatus 8. Here, the shutter 4 is engaged with the flange portion 3 in an attitude in which the developer sealing portion 4*a* faces upward.

The shutter 4 is provided with a first stopper portion 4*b* and a second stopper portion 4*c* held by first and second shutter stopper portions 8*a* and 8*b* (part (a) of FIG. 4) of the developer receiving apparatus 8 doing so that the developer supply container 1 is capable of moving relative to the shutter 4. In addition, the shutter 4 is provided with a support portion 4*d* for displaceably supporting the first and second stopper portions 4*b* and 4*c*. The support portion 4*d* is elastically deformable and extends from one side to other side of the developer sealing portion 4*a*. And, the first stopper portion 4*b* and the second stopper portion 4*c* are provided at the free end portion of the support portion 4*d*. By this, the first and second stopper portions 4*b*, 4*c* can be displaced by the elasticity of the support portion 4*d*.

Here, the first stopper portion 4*b* is inclined so that an angle $\alpha$ formed by the first stopper portion 4*b* and the support portion 4*d* is an acute angle. On the contrary, the second stopper portion 4*c* is inclined so that an angle $\beta$ formed by the second stopper portion 4*c* and the support portion 4*d* is an obtuse angle.

When the developer supply container 1 is mounted, the first stopper portion 4*b* is engaged with the guide portion 8*g* of the developer receiving apparatus 8 and is displaced to pass through the second shutter stopper portion 8*b*, thus engaging with the first shutter stopper portion 8*a*. By engaging the first stopper portion 4*b* and the first shutter stopper portion 8*a*, the position of the shutter 4 with respect to the developer receiving apparatus 8 is fixed, and the shutter 4 and the developer supply container 1 can move relative to each other. And, as the shutter 4 and the developer supply container 1 move relative to each other, the shutter opening 4*j* and the container discharge opening 3*a*4 are opened and closed. That is, when the developer supply container 1 is mounted, the developer can be discharged from the developer supply container 1, and when the developer supply container 1 is removed, the developer is not discharged from the developer supply container 1.

The second stopper portion 4*c* is engaged with the second shutter stopper portion 8*b* of the developer receiving apparatus 8 at the time of removing the developer supply container 1 so that the first stopper portion 4*b* disengages from the first shutter stopper portion 8*a*. By this, the shutter 4 is disengaged from the developer receiving apparatus 8.

[Pump Portion]

Referring to parts (a) and (b) of FIG. 10, the pump portion 5 will be described. The pump portion 5 alternately and repeatedly changes the internal pressure of the developer accommodating portion 2*c*, switching between a state lower than the atmospheric pressure and a state higher than atmospheric pressure by the driving force received by the drive receiving portion 2*d* of the container body 2 (FIG. 6). In this embodiment, in order to stably discharge the developer through the small container discharge opening 3*a*4 as described above, the pump portion 5 is provided at a portion of the developer supply container 1. The pump portion 5 is a displacement type pump in which a volume is changed. More specifically, the pump portion 5 employed in this embodiment has a bellows-like stretchable member capable of expanding and contracting.

The pressure inside the developer supply container 1 is changed by the expansion and contracting operations of the pump portion 5, and the developer is discharged by utilizing the pressure. More specifically, when the pump portion 5 is contracted, the interior of the developer supply container 1 is brought into a compressed state, and the developer is pushed out to discharge through the container discharge opening 3*a*4 of the developer supply container 1. In addition, when the pump portion 5 is expanded, the interior of the developer supply container 1 is brought into a reduced pressure state, and the air is taken in from the outside through the container discharge opening 3*a*4. By air taken in, the developer in the container discharge opening 3*a*4 and in the neighborhood of the storage portion that stores the developer transported from the container body 2 of the flange portion 3 is loosened and smoothly discharged.

That is, in the neighborhood of the container discharge opening 3*a*4 of the developer supply container 1 and the neighborhood of the storage portion, the developer in the developer supply container 1 may gather due to vibrations imparted when transporting the developer supply container 1 and so on, with the possible result that the developer is caked in this portion. Therefore, as described above, the air is taken in through the container discharge opening 3*a*4, so that it is possible to loosen the developer that has been caked. In addition, in the usual discharging operation of the developer, as air is taken in as described above, the air and the powder as the developer are mixed with the result that the flowability of the developer is enhanced, and therefore, clogging of the developer does not easily occur, as an additional advantage. By repeatedly performing the expansion and contracting operation as described above, the developer is discharged.

As shown in part (a) of FIG. 10, in the pump portion 5, a joint portion 5*b* is provided so as to be able to be joined with the flange portion 3 on the opening end side (dismounting direction B). In this embodiment, screw threads are formed as the joint portion 5*b*. In addition, as shown in part (b) of FIG. 10, the pump portion 5 has a reciprocating member engaging portion 5*c* which engages with the reciprocating member 6 (parts (a) and (b) of FIG. 11), which will be described hereinafter, on the other end side.

In addition, as shown in part (b) of FIG. 10, the pump portion 5 has a bellows-shaped expandable portion (bellows portion, expansion and contraction member) 5*a* in which crests and bottoms are alternately formed periodically. The expansion and contraction portion 5*a* is capable by being folded in the direction of the arrow A or expanded in the direction of the arrow B along the folding lines (with folding lines as the base point). Therefore, when the bellows-like pump portion 5 as employed in this embodiment, it is possible to reduce variations in volumetric change with respect to the expansion and contraction amount, and therefore, it is possible to accomplish the stable volumetric change.

Here, in this embodiment, polypropylene resin is used as the material of the pump portion 5, but the present invention is not limited to this example. As for the material (material) of the pump portion 5, any material may be used as long as it has an expansion and contraction function and is capable of changing the internal pressure of the developer accommodating portion by changing the volume. For example, ABS (acrylonitrile-butadiene-styrene copolymer), polystyrene, polyester, polyethylene, and so on are usable. Or, rubber, other stretchable materials or the like can also be used.

[Reciprocating Member]

Referring to parts (a) and (b) of FIG. 11, the reciprocating member 6 will be described. As shown in parts (a) and (b) of FIG. 11, in order to change the volume of the pump portion 5, the reciprocating member 6 is provided with a pump engaging portion 6*a* (part (b) of FIG. 10) which engages with the reciprocating member engaging portion 5*c* provided on the pump portion (part (b) of FIG. 10). In addition, the reciprocating member 6 is provided with an engaging projection 6*b* to be engaged with the above-described cam groove 2*b* (FIG. 8) at the time of assembly. The engaging projection 6*b* is provided at the free end portion of the arm 6*c* extending in the mounting and dismounting direction (arrows A and B in the Figure) from the neighborhood of the pump engaging portion 6*a*. In addition, the reciprocating member 6 is regulated in rotation around the rotation axis P (FIG. 8) of the arm 6*c* by the reciprocating member holding portion 7*b* (part (b) of FIG. 12) of the cover 7 which will be described hereinafter. Therefore, when the container body 2 is driven by the drive receiving portion 2*d* by the driving gear 9, and the cam groove 2*b* rotates integrally, the reciprocating member 6 reciprocates back and forth in the directions A and B by the urging action of the engaging projection 6*b* fitted in the cam groove 2*b* and the reciprocating member holding portion 7*b* of the cover 7. Accordingly, the pump portion 5 engaged with the pump engaging portion 6*a* of the reciprocating member 6 by way of the reciprocating member engaging portion 5*c* expands and contracts in the direction B and the direction A.

[Cover]

Referring to parts (a) and (b) of FIG. 12, the cover 7 will be described. As described above, the cover 7 is provided as shown in FIG. 6 and part (b) of FIG. 7 for the purpose of improving the appearance of the developer supply container 1 and protecting the reciprocating member 6 and the pump portion 5. In more detail, the cover 7 is provided so as to cover the entirety of the flange portion 3, the pump portion 5, and the reciprocating member 6. As shown in part (a) of FIG. 12, the cover 7 is provided with a guide groove 7*a* to be guided by the insertion guide 8*e* (part (a) of FIG. 3) of the developer receiving apparatus 8. In addition, as shown in part (b) of FIG. 12, the cover 7 is provided with a reciprocating member holding portion 7*b* for restricting rotation of the reciprocating member 6 about the rotation axis P (FIG. 8).

[Operating Portion and Manipulating Portion]

Next, referring to parts (a) of FIG. 13 through part (b) of FIG. 18, the description will be made as to an operating portion 21 for displacing the developer receiving portion 11 toward the developer supply container 1 after mounting the developer supply container 1 in a predetermined position of the developer receiving apparatus 8.

First, the developer supply container 1 of this embodiment has a cover member 19, an manipulating portion 20, and an operating portion 21, in addition to the container body 2, the flange portion 3, the shutter 4, the pump portion 5, the reciprocating member 6, the cover 7 and so on described above with part (a) of FIG. 13. The cover member 19 mainly covers the container body 2 and a part of the flange portion 3. The operating portion 21 extends in the cover member 19 along the container body 2 and the flange portion 3, and the manipulating portion 20 is provided at the upstream end portion of the operating portion 21 in the mounting direction (direction of arrow A) of the developer supply container ling.

As shown in part (a) of FIG. 14, the manipulating portion 20 has a gripping portion 20*b* which is formed so that the base end portions of the pair of arm portions are connected by the connecting portion, and supporting holes 20*a* and connecting holes 20*c* are provided in this order from the free end side at the free end portions of the pair of arm portions, respectively. As shown in parts (b) and (c) of FIG. 13, the rotation supporting shaft 19*b* provided at the upstream end portion of the cover member 19 in the mounting direction is rotatably fitted in the support hole 20*a*. By this, the manipulating portion 20 is rotatable about a rotation support shaft (rotation shaft) 19*b*. In addition, a connecting shaft 21*b* provided at an upstream end portion, in the mounting direction, of the operating portion 21 described below is inserted through the connecting hole 20*c*. By this, the manipulating portion 20 and the operating portion 21 are connected by way of the connection shaft 21*b*, and the operating portion 21 operates in interrelation with the operation of the manipulating portion 20.

As shown in parts (a) and (b) of FIG. 14, the operating portion 21 has a base portion 21*a*, and a pair of arm portions 21*c* which extends toward the downstream side, in the mounting direction (longitudinal direction), of the developer supply container 1 with the both ends of the base portion 21*a* and the base portion 21*a* as starting points. A connecting shaft 21*b* (parts (b) and (c) of FIG. 13) fitted with the above-mentioned connecting hole 20*c* is provided on the base end side of each arm portion 21*c*. In addition, an engaging portion 21*d* engageable with the engaged portion 11*b* formed in the developer receiving portion 11 is formed at the free end portion of each arm portion 21*c*. Also, a supporting shaft 21*e* is provided between the connecting shaft 21*b* of each arm portion 21*c* and the engaging portion 21*d*. As shown in part (a) of FIG. 13, the supporting shaft 21*e* is engaged with a supporting groove 19*a* provided in the cover member 19. The supporting groove 19*a* is inclined upward toward the downstream (direction of arrow A) in the mounting direction.

Here, after mounting of the developer supply container 1, the position of the manipulating portion 20 in the state of part (b) of FIG. 13 in which the manipulating portion 20 is not yet operated is a first position, and the position with the state of part (c) in FIG. 13 where the receiving opening 11*a* communicates with the shutter opening 4*j* after the manipulating portion 20 is operated, as will be described hereinafter is a second position.

When the operator inserts the developer supply container 1 into the apparatus main assembly 100*a* and mounts it in a predetermined position of the developer receiving apparatus 8, the engaging portion 21*d* abuts to the lower surface of the engaged portion 11*b*, as shown in FIG. 15. At this time, the manipulating portion 20 is kept in the first position of part (b) of FIG. 13. In addition, when the manipulating portion 20 is in the first position, the container discharge opening 3*a*4, the shutter opening 4*j* of the shutter 4, and the receiving opening 11*a* of the developer receiving portion 11 are at the same position with respect to the mounting direction (the direction of arrows A and B) of the developer supply container 1, as shown in part (a) of FIG. 16. In addition, the container discharge opening 3*a*4, the shutter opening 4*j*, and the receiving opening 11*a* are positioned substantially on the same line in the vertical direction (arrows X, y direction), but the receiving opening 11*a* and the shutter opening 4*j* are in a position away from each other in the vertical direction, and therefore they are not in communication with each other. At this time, the developer in the developer supply container 1 can be discharged, but the diameter of the shutter opening 4*j* is minute and only a very small amount of the developer may fall due to its own weight, and therefore, scattering or the like hardly occurs unless a signal for driving the developer supply container 1 is produced.

When the operator rotates the manipulating portion 20 from the first position to the second position in the direction of the arrow V1 after mounting the developer supply container 1 at the predetermined position, as shown in part (b) of FIG. 13 to part (c) of FIG. 13, the operating portion 21 performs a predetermined operation, as shown in FIG. 17. That is, the operating portion 21 is displaced in interrelation with the rotation of the manipulating portion 20 so that the engaging portion 21*d* and the engaged portion 11*b* are engaged to displace, that is, raise the developer receiving portion 11 so that the receiving opening 11*a* communicates with the shutter opening 4*j*. Therefore, in this embodiment, the predetermined operation is an operation in which the operating portion 21 is displaced in interrelation with the rotation of the manipulating portion 20.

More detailed description will be made. As shown in FIG. 17, when the manipulating portion 20 rotates in the direction of arrow V1 about the rotation supporting shaft 19*b*, the operating portion 21 relatively rotates in the direction of the arrow W about the connecting shaft 21*b* with the manipulating portion 20 as a rotation center, relative to the manipulating portion 20. By this, the manipulating portion 20 and the operating portion 21 move from the position indicated by the solid line in FIG. 17 to the position indicated by the broken line. In other words, the operating portion 21 is pushed to the downstream side in the mounting direction in interrelation with the rotation of the manipulating portion 20. As described in the foregoing, the supporting shaft 21*e* provided in the operating portion 21 is engaged with a supporting groove 19*a* provided in the cover member 19, and therefore, the supporting shaft 21*e* moves along the supporting groove 19*a* by pushing the operating portion 21 in interrelation with the rotation of the manipulating portion 20.

As mentioned above, the supporting groove 19*a* is inclined upward toward the downstream in the mounting direction, and therefore, the engaging portion 21*d* engaged with the engaged portion 11*b* is raised. By this, the engaging portion 21*d* lifts the engaged portion 11*b* in the direction of the arrow X, from the position shown by the solid line in FIG. 17 and the position shown in part (a) of FIG. 18, to the position shown the broken line in FIG. 17 and the position shown in part (b) in FIG. 18. At this time, as shown in part (b) of FIG. 16, the developer receiving portion 11 is displaced upward and the receiving opening 11*a* is in a state of communicating with the shutter opening 4*j*.

Here, when dismounting the developer supply container 1, the engaging portion 21*d* is displaced downward, by pivoting the manipulating portion 20 in the opposite direction to that described above. At this time, the developer receiving portion 11 is urged downward in the vertical direction by the urging member 12 (FIG. 5), and therefore, it is displaced in a direction away from the developer supply container 1 as the engaging portion 21*d* is displaced downward. Thereafter, by moving the developer supply container 1 in the dismounting direction (direction opposite to the mounting direction (direction of arrow B)), the shutter 4 closes the container discharge opening 3*a*4, and it is possible to remove the developer supply container 1.

As described above, in this embodiment, after mounting the developer supply container 1 to the developer receiving apparatus 8, the manipulating portion 20 is operated to displace the developer receiving portion 11 to bring the receiving opening 11*a* into communication with the shutter opening 4*j*. For this reason, the developer receiving portion 11 can be connected to the developer supply container 1. That is, in the case of this embodiment, as contrasted to the structure described in Patent Document 1, the developer receiving portion is not displaced in accordance with the mounting operation of the developer supply container, and therefore, it is possible to connect the developer receiving portion to the developer supply container more reliably regardless of the mounting operation of the developer supply container, that this, regardless of the attitude or momentum at the time of mounting the developer supply container 1.

Embodiment 2

Referring to FIG. 19 through part (b) of FIG. 22, Embodiment 2 will be described. In this embodiment, the structure of an manipulating portion 20A and an operating portion 21A is different from the structure of that in Embodiment 1. Other structures and operations are the same as those in Embodiment 1 described above, and therefore, the illustration and explanation of the same structures will be omitted or simplified, and the following description mainly focuses on portions different from Embodiment 1.

As shown in FIG. 19, also in the case of this embodiment, the developer supply container 1A includes a cover member 19A, an manipulating portion 20A, and an operating portion 21A (FIG. 21), a container body 2 and so on. The cover member 19A covering the container body 2 and so on rotatably supports a shaft 20Ad (FIG. 21) connected to a grip portion 20Ab of the manipulating portion 20A. The shaft 20Ad is arranged substantially parallel to the mounting direction (longitudinal direction) of the developer supply container 1A in the cover member 19A. As shown in parts (a) and (b) of FIG. 20, the manipulating portion 20A is rotatable about a central axis (rotational axis) of the shaft 20Ad, with the shaft 20Ad.

As shown in FIG. 21, the manipulating portion 20A has a grip portion 20Ab, a shaft 20Ad, and a cam portion 20Ae. That is, the grip portion 20Ab is fixed to the upstream end portion in the mounting direction of the shaft 20Ad, and the cam portion 20Ae is fixed to the downstream end portion in the mounting direction. These are rotatable integrally with the cover member 19A. In addition, in the cover member 19A, the operating portion 21A is disposed so as to be engageable with the cam portion 20Ae.

The operating portion 21A is held so as to be displaceable only in the vertical direction by a holding portion (not shown) of the cover member 19A. As shown in FIG. 21, such an operating portion 21A has a base portion 21Aa and a pair of arm portions 21Ac which extend from respective ends of the base portion 21Aa in the longitudinal direction (downstream side in the mounting direction) of the developer supply container 1A. An engaging portion 21Ad capable of engaging with the engaged portion 11*b* (FIG. 15) formed in the developer receiving portion 11 is formed at the free end portion of the associated arm portion 21Ac. In addition, the operating portion 21A is held at a position in the vertical direction by the cam portion 20Ae of the manipulating portion 20A by way of the base portion 21Aa.

Here, after mounting the developer supply container 1A, the position of the manipulating portion 20A in the state of part (a) of FIG. 20 in which the manipulating portion 20A is not yet operated the first position. In addition, after operation of the manipulating portion 20A, the position in the state of part (b) of FIG. 20 where the receiving opening 11*a* communicates with the shutter opening 4*j* as will be described hereinafter is the second position.

When the operator inserts the developer supply container 1A into the apparatus main assembly 100*a* and mounts it at a predetermined position of the developer receiving apparatus 8, the engaging portion 21Ad abuts to the lower surface of the engaged portion 11*b* as in the case shown in FIG. 15. At this time, the manipulating portion 20A holds the first position of part (a) of FIG. 20, and the phase of the cam portion 20Ae is the phase shown in part (a) of FIG. 22. In addition, when the manipulating portion 20A is in the first position, the receiving opening 11*a* and the shutter opening 4*j* are located at positions away from each other in the vertical direction, and therefore are not in communication with each other, as shown in part (a) of FIG. 16.

When the operator rotates the manipulating portion 20A from the first position to the second position in the direction of the arrow V2 after mounting the developer supply container 1A in the predetermined position, as shown in parts (a) and (b) of FIG. 20, the operating portion 21A performs a predetermined operation, as shown in parts (a) and (b) of FIG. 22. That is, the operating portion 21A is displaced in interrelation with the rotation of the manipulating portion 20A so that the engaging portion 21Ad and the engaged portion 11*b* are engaged with each other, and the developer receiving portion 11 is displaced, that is, raised so that the receiving opening 11*a* communicates with the shutter opening 4*j*. Therefore, also in this embodiment, the predetermined operation is an operation in which the operating portion 21A is displaced in interrelation with the rotation of the manipulating portion 20A.

The detailed description will be made. As shown in parts (a) and (b) of FIG. 20, when the manipulating portion 20A rotates about the shaft 20Ad in the direction of the arrow V2, the cam portion 20Ae rotates in the direction of the arrow V2 from the position shown in part (a) of FIG. 22 to the position shown in part (b) of FIG. 22. As described in the foregoing, the operating portion 21A is held in the vertical position by the cam portion 20Ae, and therefore, the operating portion 21A is displaced in the arrow X direction in accordance with the rotation of the cam portion 20Ae, as shown in part (b) of FIG. 22. By this, the engaging portion 21Ad engaged with the engaged portion 11*b* is raised. By this, as in Embodiment 1, the developer receiving portion 11 is displaced vertically upward toward the developer supply container 1A, and the shutter opening 4*j* and the receiving opening 11*a* communicate with each other, as shown in part (b) of FIG. 16.

Here, when removing the developer supply container 1A, the engaging portion 21Ad is displaced downward as in Embodiment 1, by pivoting the manipulating portion 20A in the opposite direction to that described above. Thereafter, as in Embodiment 1, the developer supply container 1A can be dismounting.

Embodiment 3

Referring to part (b) of FIGS. 23 to 27, Embodiment 3 will be described. In this embodiment, the structure of the manipulating portion 20B and the operating portion 21B is different from the structure of Embodiment 1. Other structures and actions are the same as in Embodiment 1 described above, and therefore, the illustration and explanation of the same structure will be omitted or simplified, and the following description mainly focuses on portions different from Embodiment 1.

As shown in FIG. 23, also in the case of this embodiment, the developer supply container 1B has a cover member 19B, an manipulating portion 20B, an operating portion 21B (part (a) of FIG. 24) in addition to container body 2 and so on. The manipulating portion 20B is dismountably mounted to the cover member 19B covering the container body 2 and the like.

As shown in part (a) of FIG. 24, the operating portion 21B includes a base portion 21Ba and a pair of arm portions 21Bc which extend from respective ends of the base portion 21Ba in the longitudinal direction (downstream side in the mounting direction) of the developer supply container 1B. An engaging portion 21Bd engageable with the engaged portion 11*b* (FIG. 15) formed in the developer receiving portion 11 is formed at the free end portion of each arm portion 21Bc. In addition, the operating portion 21B is held so as to be displaceable only in the vertical direction by a holding portion (not shown) of the cover member 19B.

The operating portion 21B of this embodiment further includes a compression spring 41 as an urging means and a regulating portion 21Bf (part (b) of FIG. 26 and so on). As shown in part (a) of FIG. 24, a total of four such compression springs 41 are disposed, that is, two compression springs 4 leach between the lower surface of the end of the pair of arm portion 21Bc and the cover member 19B (not shown in part (a) of FIG. 24). And, the compression spring 41 urges the entire operating portion 21B in the vertically upward direction, the direction of the arrow X). That is, the compression spring 41 urges the engaging portion 21Bd provided on the free end side of the operating portion 21B in the direction (vertically upwardly) in which the receiving opening 11*a* is brought into communication with the shutter opening 4*j* (parts (a), (b) in FIG. 16). Here, the compression spring 41 is a coil spring as shown in part (b) of FIG. 24, but the urging means may be another member such as a leaf spring. The total of the urging forces of the compression springs 41 is larger than the urging force of the urging member 12 (FIG. 5) urging the developer receiving portion 11 downward in the vertical direction.

The regulating portion 21Bf is engageable with the manipulating portion 20B, and regulates the position of the engaging portion 21Bd against the urging force of the compression spring 41 in the state of engagement with the manipulating portion 20B. The regulating portion 21Bf is formed in a recess shape on the upper surface of the base portion 21Ba into which the supporting portion 20Bf of the manipulating portion 20B which will be described in detail hereinafter can freely enter.

As shown in FIG. 25, the manipulating portion 20B comprises a supporting portion 20Bf and a grip portion 20Bb formed integrally with an end portion of the supporting portion 20Bf. Here, at the upstream end portion of the cover member 19B in the mounting direction of the developer supply container 1B, a fixing hole 19Bc is formed, and the supporting portion 20Bf can be inserted into the fixing hole 19Bc. As shown in FIG. 23 and so on, the grip portion 20Bb projects toward the upstream side of the cover member 19B in the mounting direction, with the supporting portion 20Bf inserted in the fixing hole 19Bc.

As shown in part (a) of FIG. 26 and part (a) of FIG. 27, in a state of being inserted into the fixing hole 19Bc, the supporting portion 20Bf projects toward the downstream side, in the mounting direction, of the fixing hole 19Bc, and it engages with the regulating portion 21Bf of the operating portion 21B. That is, the lower surface of the supporting portion 20Bf abuts to the regulating portion 21Bf. In this engaged state, the position of the entire operating portion 21B is restricted, so that it will not be displaced upward in the vertical direction against the urging force of the compression spring 41.

On the other hand, when the operator grips the grip portion 20Bb and pulls the supporting portion 20Bf out of the fixing hole 19Bc by pulling it toward the upstream side in the mounting direction, the engagement between the supporting portion 20Bf and the regulating portion 21Bf is released, as shown in part (b) of FIG. 26 and part (b) of FIG. 27. By this, the entire operating portion 21B is displaced upward in the vertical direction by the urging force of the compression spring 41. As described above, the manipulating portion 20B can be operated so as to engage with and disengage from the regulating portion 21Bf.

Here, the position of manipulating portion 20B in the state shown in part (a) of FIG. 26 and part (a) of FIG. 27 in which the supporting portion 20Bf and the regulating portion 21Bf are engaged with each other without operating the manipulating portion 20B after the mounting of the is the first position. On the other hand, by operating (pulling out) the manipulating portion 20B, the engagement between the supporting portion 20Bf and the regulating portion 21Bf is released, and the receiving opening 11*a* communicates with the shutter opening 4*j* as will be described hereinafter, as shown in part (b) of FIG. 26 and part (b) of FIG. 27), and the position of the operating portion in the state is the second position.

When the operator inserts the developer supply container 1B into the apparatus main assembly 100*a* and mounts it at a predetermined position of the developer receiving apparatus 8, and the engaging portion 21Bd abuts to the lower surface of the engaged portion 11*b*, as in the case shown in FIG. 15. At this time, the manipulating portion 20B holds the first position shown in part (a) of FIG. 26 and part (a) of FIG. 27, and the operating portion 21B holds the engagement between the supporting portion 20Bf and the regulating portion 21Bf to regulate the position of the operating portion 21B. In addition, when the manipulating portion 20B is positioned at the first position, the receiving opening 11*a* and the shutter opening 4*j* are in a position away from each other in the vertical direction and are not communicating with each other, as shown in part (a) of FIG. 16.

After the developer supply container 1B is mounted in a predetermined position, when the operator pulls out the manipulating portion 20B from the fixing hole 19Bc, that is, when the manipulating portion 20B is operated from the first position to the second position the operating portion 21B performs a predetermined operation, as shown in part (b) of FIG. 26 and part (b) of FIG. 27. That is, by releasing the engagement between the supporting portion 20Bf and the regulating portion 21Bf, the operating portion 21B is displaced by the urging force of the compression spring 41. And, by the engagement between the engaging portion 21Bd and the engaged portion 11*b*, the operating portion 21B displaces, that is, raises the developer receiving portion 11 so that the receiving opening 11*a* communicates with the shutter opening 4*j*. By this, as in Embodiment 1, the developer receiving portion 11 is displaced vertically upward toward the developer supply container 1B, so that the shutter opening 4*j* and the receiving opening 11*a* communicate with each other, as shown in part (b) of FIG. 16.

Here, in this embodiment, the predetermined operation is an operation of displacing the engaging portion 21Bd by the urging force of the compression spring 41 by releasing the engagement between the manipulating portion 20B and the regulating portion 21Bf.

In addition, when removing the developer supply container 1B, the operator, for example pushes a part of the operating portion 21B exposed on the upstream side in the mounting direction from the cover member 19B, downwardly against the urging force of the compression spring 41, and inserts the manipulating portion 20B again into the fixing hole 19Bc. And, the supporting portion 20Bf and the regulating portion 21Bf are engaged with each other. By this, the engaging portion 21Bd is held in a state of being lowered downward, and it is possible to remove the developer supply container 1B. Thereafter, as in Embodiment 1, the developer supply container 1B can be dismounted.

Embodiment 4

Referring to FIG. 28 through part (b) of FIG. 33, Embodiment 4 will be described. In this embodiment, the open/close cover 50 which can open and close the opening 100*b* (FIG. 2) of the apparatus main assembly 100*a* also serves as the operating section, as is different from Embodiment 1. In addition, the structure of the operating portion 21C is different from the structure of Embodiment 1. Other structures and operations are the same as in Embodiment 1 described above, and therefore, the illustration and explanation of the same structure will be omitted or simplified, and the following description mainly focuses on portions different from Embodiment 1.

As shown in FIG. 28 and FIG. 29, the developer supply container 1C has a cover member 19C and an operating portion 21C, in addition to the container body 2 and so on. As shown in FIG. 29, the operating portion 21C has a base portion 21Ca and a pair of arm portions 21Cc which extend from respective ends of the base portion 21Ca toward the longitudinal direction (downstream side in the mounting direction) of the developer supply container 1C. An engaging portion 21Cd engageable with the engaged portion 11*b* (FIG. 15) formed in the developer receiving portion 11 is formed at the free end portion of each arm portion 21Cc. The base portion 21Ca, the pair of arm portions 21Cc constitute a body portion 23, and the body portion 23 is integrally provided with the engaging portion 21Cd at the free end portion thereof. The body portion 23 of the operating portion 21C is held so as to be displaceable only in the vertical direction by a holding portion (not shown) of the cover member 19C.

As in Embodiment 3, the operating portion 21C of this embodiment further includes a compression spring 41 as an urging means and a regulating portion 21Cf (parts (a) and (b) of FIG. 33). The compression spring 41 urges the entire operating portion 21C (upward in the vertical direction, the direction of the arrow X). That is, the compression spring 41 urges the engaging portion 21Cd provided on the free end side of the operating portion 21C 16 (in the vertical direction upward) in which the receiving opening 11*a* is brought into communication with the shutter opening 4*j* (parts (a), (b) in FIG. 16). The regulating portion 21Cf as the first regulating portion has a recess portion on the upper surface of the base portion 21Ca into which the supporting portion 22*a* of the movable member 22 which will be described in detail hereinafter is capable of entering.

The movable member 22 as the second regulating portion is engageable with the regulating portion 21Cf, and regulates the position of the engaging portion 21Cd against the urging force of the compression spring 41, while being in engagement with the regulating portion 21Cf. As shown in FIG. 28, such a movable member 22 is mounted so as to be movable in the mounting direction (direction of arrow A) relative to the cover member 19C.

In addition, as shown in FIG. 30, the movable member 22 has a supporting portion 22*a*, an insertion portion 22*b*, a pair of guide projections 22*d*, and a base portion 22*e*. The supporting portion 22*a* is formed so as to project downward from the central portion of the base portion 22*e*. The insertion portion 22*b* is formed on one end side of the supporting portion 22*a* of the base portion 22*e* so that the lower surface is positioned above the lower surface of the supporting portion 22*a*. The pair of guide projections 22*d* is formed so as to project downward from the supporting portion 22*a* from the other end side than the supporting portion 22*a* of the base portion 22*e*.

As shown in part (a) of FIG. 31, this movable member 22 is arranged, in the state that the insertion portion 22*b* is inserted into the fixing hole 19Cc provided at the upstream end portion of the cover member 19C in the mounting direction of the developer supply container 1C. In addition, as shown in parts (a) and (c) of FIG. 32, a pair of guide projections 22*d* is inserted into the guide groove 19Cd formed in the bottom surface of the cover member 19C. The guide groove 19Cd is an elongated hole formed along the longitudinal direction of the developer supply container 1C and by as the guide projection 22*d* being guided by the guide groove 19Cd, the movable member 22 can move along the longitudinal direction of the guide groove 19Cd.

In addition, the opening 100*b* is provided in the portion of the apparatus main assembly 100*a* where the developer receiving apparatus 8 is provided (FIG. 2), and the open/close cover 50 capable of opening and closing the opening 100*b* is provided in the apparatus main assembly 100*a*, as shown in parts (a) and (b) of FIG. 31. The open/close cover 50 is supported so as to be rotatable in the direction of the arrow V3 about the rotational shaft 51 with respect to the main assembly 100*a* of the apparatus, and an open position for opening the opening 100*b* as shown in part (a) of FIG. 31 and a closing position for closing the opening 100*b* as shown in part (b) of FIG. 31.

As shown in parts (a) and (b) of FIG. 32, in the movable member 22, the supporting portion 22*a* is engaged with the regulating portion 21Cf of the body portion 23, and the insertion portion 22*b* projects from the fixing hole 19Cc toward the upstream side in the mounting direction. That is, the lower surface of the supporting portion 22*a* abuts to the regulating portion 21Cf. In such an engaged state, the position of the entire body 23 is restricted so as not to displace upward in the vertical direction against the urging force of the compression spring 41. At this time, the position of the movable member 22 is the first position.

On the other hand, as shown in parts (c) and (d) of FIG. 32, the movable member 22 is, when it moves from the position of parts (a) and (b) of FIG. 32 to the downstream side in the mounting direction, the engagement between the supporting portion 22*a* and the regulating portion 21Cf is released. By this, the entire body portion 23 is displaced upward in the vertical direction by the urging force of the compression spring 41. At this time, the position of the movable member 22 is the second position.

When the operator inserts the developer supply container 1C into the apparatus main assembly 100*a* and mounts it in a predetermined position of the developer receiving apparatus 8, the engaging portion 21Cd abuts to the lower surface of the engaged portion 11*b*, as in the case shown in FIG. 15. At this time, the movable member 22 holds the first position shown in parts (a) and (b) of FIG. 32 and part (a) of FIG. 33, and the position of the body portion 23 is regulated by the engagement between the supporting portion 22*a* and the regulating portion 21Cf. At this time, the free end portion 22*c* of the insertion portion 22*b* projects toward the upstream side, in the inserting direction, of the fixing hole 19Cc, that is, toward the open/close cover 50. In addition, when the movable member 22 is located at the first position, the receiving opening 11*a* and the shutter opening 4*j* are located at positions away from each other in the vertical direction and are not in communication with each other, as shown in part (a) of FIG. 16.

After mounting the developer supply container 1C at a predetermined position, the operator rotates the open/close cover 50 to the position shown in part (b) of FIG. 31, and closes the open/close cover 50 so that the operating portion 21C performs a predetermined operation. That is, the movable member 22 rotates the open/close cover 50 in the direction of the arrow V3 from the state located at the first position shown in part (a) of FIG. 33. Then, as shown in part (b) of FIG. 33, the open/close cover 50 comes into contact with the free end portion 22*c* of the movable member 22, the movable member 22 is pressed in the direction of the arrow A (downstream side in the mounting direction) by the open/close cover 50 and moves to the second position. At this time, the position of the supporting portion 22*a* of the movable member 22 is deviated from the position where it is engaged with the regulating portion 21Cf, and the engagement between the supporting portion 22*a* and the regulating portion 21Cf is released.

The body portion 23 of the operating portion 21C is displaced by the urging force of the compression spring 41 by releasing the engagement between the supporting portion 22*a* and the regulating portion 21Cf And, the body portion 23 displaces, that is, raises the developer receiving portion 11 by the engagement between the engaging portion 21Cd and the engaged portion 11*b*, so that the receiving opening 11*a* is brought into communication with the shutter opening 4*j*. By this, as in Embodiment 1, the developer receiving portion 11 is displaced vertically upward toward the developer supply container 1C, and the shutter opening 4*j* and the receiving opening 11*a* communicate with each other, as shown in part (b) of FIG. 16.

Here, in this embodiment, the predetermined operation is an operation of displacing the engaging portion 21Cd by the urging force of the compression spring 41 by releasing the engagement between the supporting portion 22*a* and the regulating portion 21Cf.

In addition, when dismounting the developer supply container 1C, the operator, for example pushes a part of the body portion 23, which is exposed from the cover member 19C toward the upstream side in the mounting direction, against the urging force of the compression spring 41 and pushes the insertion portion 22*b* of the movable member 22 again into the fixing hole 19Cc. And, the supporting portion 22*a* and the regulating portion 21Cf are brought into engagement with each other. By this, the engaging portion 21Cd is held in a state of being lowered downward, and the developer supply container 1C can be removed. Thereafter, as in Embodiment 1, the developer supply container 1C can be removed.

Other Embodiments

In the above-described description, the discharge opening with which the receiving opening 11*a* of the developer receiving portion 11 communicates is the shutter opening 4*j* of the shutter 4. However, without employing a shutter, the receiving opening of the developer receiving portion may be directly contacted to the container discharge opening of the developer supply container 1 to establish communication with each other. In this case, the container discharge opening is the discharge opening for communicating with the receiving port.

INDUSTRIAL APPLICABILITY

According to the present invention, there are provided a developer supply system suitable for an electrophotographic image forming apparatus and so on, a developer supply container mounting method, a developer supply unit developer supply system, a developer supply container mounting method, and a developer supply unit.

SYMBOLS

1, 1A, 1B, 1C=developer supply container: 2*c*=developer container: 3=flange portion: 3*a*4=container discharge opening: 4=shutter: 4*j*=shutter opening (discharge opening): 8=developer receiving apparatus: 11=developer receiving portion: 11*a*=receiving opening: 11*b*=engaged portion (portion to be engaged): 19*b*=supporting shaft: 20, 20A, 20B=manipulating portion: 20Ad=shaft (rotating shaft): 21, 21A, 21B, 21C=operating portion: 21*d*, 21Ad, 21Bd, 21Cd=engaging portion: 21Bf=regulating portion: 21Cf=regulating portion (first regulating portion): 22=movable member (second regulating portion): 41=compression spring (urging means): 50=opening/closing close cover: 100*b*=an opening: 200=developer supplying system: 300=discharge portion

The invention claimed is:

1. A developer supplying system comprising:

a developer receiving apparatus including a developer receiving portion provided with a receiving opening for receiving developer; and a developer supply container detachably mountable to the developer receiving apparatus, the developer supply container including:

a developer accommodating portion for accommodating the developer, and a discharging portion provided with a discharge opening for discharging the developer accommodated in the developer accommodating portion, wherein the developer receiving portion is provided with a force receiving portion for receiving a force for moving the developer receiving portion toward the developer supply container to bring the receiving opening into communication with the discharge opening by a manual operation after the developer supply container is mounted to the developer receiving apparatus.

2. A developer supplying system according to claim 1, wherein the force for moving the developer receiving portion toward the developer supply container to bring the receiving opening into communication with the discharge opening is applied to the developer receiving portion by an engaging part engaged with the force receiving portion by manipulating the engaging part.

3. A developer supplying system according to claim 2, wherein the engaging part is mounted to so as to maintain a communication state between the receiving opening and the discharge opening.

4. A mounting method for mounting a developer supply container to a developer receiving apparatus, the method comprising:

a first step mounting the developer supply container to the developer receiving apparatus, wherein the developer receiving apparatus includes (i) a developer receiving portion provided with a receiving opening for receiving developer, and (ii) a portion-to-be-engaged integrally displaceable with developer receiving portion, and the developer supply container includes (i) a developer accommodating portion for accommodating the developer, and (ii) a discharging portion provided with a discharge opening for discharging the developer accommodated in the developer accommodating portion; and a second step of moving the developer receiving portion toward the developer supply container to bring the receiving opening into communication with the discharge opening, after the first step.

* * * * *